US009377725B2

(12) United States Patent
Hasegawa

(10) Patent No.: US 9,377,725 B2
(45) **Date of Patent: *Jun. 28, 2016**

(54) FIXING DEVICE AND IMAGE FORMING APPARATUS INCORPORATING SAME

(71) Applicant: RICOH COMPANY, LTD., Tokyo (JP)

(72) Inventor: Kenichi Hasegawa, Atsugi (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/194,744

(22) Filed: Mar. 2, 2014

(65) Prior Publication Data

US 2014/0178092 A1 Jun. 26, 2014

Related U.S. Application Data

(60) Continuation of application No. 13/834,516, filed on Mar. 15, 2013, now Pat. No. 8,744,331, which is a division of application No. 12/823,770, filed on Jun. 25, 2010, now Pat. No. 8,417,169.

(30) Foreign Application Priority Data

Jul. 29, 2009 (JP) ..... 2009-175987

(51) Int. Cl.
*G03G 15/20* (2006.01)

(52) U.S. Cl.
CPC ..... *G03G 15/2017* (2013.01); *G03G 15/2032* (2013.01); *G03G 15/2053* (2013.01); *G03G 15/2064* (2013.01); *G03G 2215/2035* (2013.01)

(58) Field of Classification Search
CPC ..... G03G 15/2017; G03G 15/2032; G03G 15/2064; G03G 15/2053; G03G 2215/2035
USPC ..... 399/98, 329, 328, 122
See application file for complete search history.

(56) References Cited

U.S. PATENT DOCUMENTS 5,400,123 A 3/1995 Sato et al.
6,131,009 A 10/2000 Hasegawa (Continued)

FOREIGN PATENT DOCUMENTS

JP H07-191561 A 7/1995
JP 2008-146010 6/2008

(Continued)

OTHER PUBLICATIONS

Office Action issued Jun. 4, 2013 Japanese Patent Application No. 2009-175987.

*Primary Examiner* — Rodney Bonnette
(74) *Attorney, Agent, or Firm* — Oblon, McClelland, Maier & Neustadt, L.L.P.

(57) ABSTRACT

A fixing device includes a hollow, open-sided stationary heat roller, a flexible fuser belt, a fuser pad, a rotatable pressure member, a reinforcing member, and a sealing mechanism. The heat roller defines an elongated longitudinal side opening that opens into a hollow interior thereof. The fuser belt is looped for rotation around the heat roller to transfer heat radially outward from the roller circumference. The fuser pad is held substantially stationary along the roller opening outward from the roller interior and inward from the loop of the fuser belt. The pressure member is pressed against the fuser pad through the fuser belt to form a fixing nip. The reinforcing member is disposed within the roller interior to thrust against the fuser pad through the roller opening. The sealing mechanism is disposed on the roller opening to prevent foreign matter from entering the roller interior through the roller opening.

44 Claims, 8 Drawing Sheets

(56) References Cited

U.S. PATENT DOCUMENTS

| | | | |
|---|---|---|---|
| 6,496,666 | B2 | 12/2002 | Hayashi et al. |
| 6,591,081 | B2 | 7/2003 | Hasegawa |
| 7,070,182 | B2 | 7/2006 | Hasegawa |
| 7,515,850 | B2 | 4/2009 | Hasegawa |
| 7,630,652 | B2 | 12/2009 | Hasegawa |
| 8,064,798 | B2 | 11/2011 | Shinshi et al. |
| 8,160,484 | B2 | 4/2012 | Hasegawa et al. |
| 8,195,076 | B2 | 6/2012 | Shinshi |
| 8,219,015 | B2 | 7/2012 | Shinshi et al. |
| 8,219,016 | B2 | 7/2012 | Hasegawa et al. |
| 8,364,052 | B2 | 1/2013 | Iwaya et al. |
| 2006/0029411 | A1 | 2/2006 | Ishii et al. |
| 2007/0014600 | A1 | 1/2007 | Ishii et al. |
| 2008/0112739 | A1* | 5/2008 | Shinshi ..... 399/329 |
| 2008/0298862 | A1 | 12/2008 | Shinshi |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2011/0085832 | A1 | 4/2011 | Hasegawa et al. |
| 2011/0217094 | A1 | 9/2011 | Hasegawa |

FOREIGN PATENT DOCUMENTS

| | | |
|---|---|---|
| JP | 2008-158482 | 7/2008 |
| JP | 2009-3410 A | 1/2009 |

* cited by examiner

FIXING DEVICE AND IMAGE FORMING APPARATUS INCORPORATING SAME

CROSS-REFERENCE TO RELATED APPLICATIONS

The present patent application is a continuation application of U.S. application Ser. No. 13/834,516, filed on Mar. 15, 2013, which is a divisional application of U.S. application Ser. No. 12/823,770 (now U.S. Pat. No. 8,417,169), filed on Jun. 25, 2010, which claims priority pursuant to 35 U.S.C. §119 from Japanese Patent Application No. 2009-175987, filed on Jul. 29, 2009, each of which are hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile, printer, plotter, or multifunctional machine incorporating several of those imaging functions, incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical, looped belts or rollers, one being heated for fusing toner ("fuser member") and the other being pressed against the heated one ("pressure member"), which together form a heated area of contact called a fixing nip through which a recording medium is passed to fix a toner image under heat and pressure.

One conventional type of fuser assembly employed in the fixing device is an endless belt looped for rotation around a generally cylindrical, stationary heat pipe typically formed by rolling a thin sheet of thermally conductive metal. The heat pipe has a heater inside or outside the pipe hollow to conduct or carry heat over its circumference, from which heat is radially transferred to the length of the fuser belt rotating around the heat pipe. Using a thin-walled conductive heat pipe allows for heating the fuser belt swiftly and uniformly, resulting in shorter periods of warm-up time and first-print time required to complete an initial print job upon startup, and high immunity against printing failures caused by insufficient heating of the fixing nip in high-speed application.

Currently, two different configurations of heat pipes are available for use in electrophotographic fixing devices. One is a generally cylindrical, open-sided roller formed by bending a sheet of thermally conductive material into a rolled configuration with a substantially C-shaped cross-section defining an elongated opening or slit on one side thereof. The other is a completely closed cylindrical roller formed by bending a sheet of thermally conductive material into a rolled configuration, followed by bonding or welding together two opposed longitudinal edges of the rolled sheet to obtain a cylinder with a completely closed cross-section.

A generally cylindrical, open-sided heat pipe is used in combination with a separate fuser pad held stationary in its side opening outside the pipe hollow and inside the loop of a fuser belt entrained around the heat pipe, with adequate spacing left between adjoining surfaces of the heat pipe and the fuser pad. When assembled into a fixing device, the open-sided heat pipe has its open side facing a pressure member extending parallel to the length of the pipe, so that the fuser pad is pressed against the pressure member through the thickness of the fuser belt to form a fixing nip.

On the other hand, a completely closed cylindrical heat pipe is equipped with a reinforcing member held stationary within the pipe hollow against the inner circumference of the pipe for reinforcement purposes. When assembled, the completely closed heat pipe has its outer circumference facing a pressure member extending parallel to the length of the pipe, with the reinforcing member supporting those portions of the pipe circumference pressed against the pressure member to form a fixing nip.

Of the two types of heat pipe described above, the open-sided design is advantageous in terms of protection against deformation under nip pressure. That is, provision of the separate fuser pad enables the open-sided heat pipe to operate substantially in isolation from the pressure member, which can thus maintain its generally cylindrical configuration without bending or bowing away from the fixing nip under nip pressure. Such stability against deformation of the heat pipe in turn protects the fuser belt against damage and failure and results in proper operation of the fixing device, even where the heat pipe is extremely thin-walled to obtain high thermal efficiency in heating the fuser belt.

Although advantaged over its counterpart in terms of mechanical stability, the open-sided heat pipe has a drawback in that it can allow entry of foreign matter into the hollow interior through the side opening, in particular a lubricating agent provided to reduce friction between the adjoining surfaces of the heat pipe and the fuser belt. Leaking lubricant from outside to inside the heat pipe not only results in loss of lubrication, which causes high friction at the interface to aggravate wear and tear of the contacting surfaces, but also results in malfunctioning of or damage to the pipe heater where lubricant adheres to the heater and evaporates in the pipe hollow.

By contrast, the completely closed cylindrical heat pipe is exempt from entry of foreign matter and leakage of lubricant into the pipe hollow, since there is no access to the inside of the pipe from the outside along the circumference of the closed heat pipe.

However, the completely closed heat pipe tends to develop deformation as it is subjected to pressure contact with the pressure member during operation, despite the provision of a reinforcing member supporting the pipe circumference. This tendency toward deformation is pronounced where the heat pipe is formed of an extremely thin sheet of material for obtaining maximum thermal efficiency, where the pressure member applies a higher nip pressure to obtain a longer fixing nip and more efficient fixing performance, and most particularly, where the heat pipe is subjected to varying nip pressure or repeatedly strikes the pressure member as the pressure member moves toward and away from the heat pipe to adjust length and strength (pressure) of the fixing nip.

If not corrected, deformation of the heat pipe results in various defects due to interference or mis-coordination between the fuser belt and the heat pipe, such as the belt getting damaged or making noise by locally and excessively rubbing against the heat pipe. Such defects can be unacceptable where the fixing device incorporates the capability to adjust the length and pressure of the fixing nip by moving the pressure member relative to the heat pipe.

Thus, the two conventional types of heat pipe each has advantages and drawbacks compared to each other in terms of mechanical stability of the cylindrical configuration and immunity against entry of foreign matter into the pipe hollow. As long as this trade-off remains unsolved, neither is satisfactory for providing a reliable high-speed fixing device that can operate with extremely short warm-up time and first-print time, while highly immune to failures caused by insufficient heating of the fuser belt in high speed application.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a hollow, open-sided stationary heat roller, a flexible fuser belt, a fuser pad, a rotatable pressure member, a reinforcing member, and a sealing mechanism. The heat roller is configured to heat an outer circumference thereof, and has an elongated longitudinal side opening therein that opens into a hollow interior thereof. The fuser belt is looped for rotation around the heat roller to transfer heat radially outward from the roller circumference. The fuser pad is held substantially stationary along the roller opening outward from the roller interior and inward from the loop of the fuser belt. The pressure member is pressed against the fuser pad through the fuser belt to form a fixing nip through which a recording medium is passed to fix a toner image under heat and pressure. The reinforcing member is disposed within the roller interior to thrust against the fuser pad through the roller opening for reinforcement. The sealing mechanism is disposed on the roller opening to prevent foreign matter from entering the roller interior through the roller opening.

Other exemplary aspects of the present invention are put forward in view of the above-described circumstances, and provide a novel image forming apparatus.

In one exemplary embodiment, the image forming apparatus includes an electrophotographic imaging unit and a fixing device. The imaging unit forms a toner image on a recording medium. The fixing device fixes the toner image in place on the recording medium, and includes a hollow, open-sided stationary heat roller, a flexible fuser belt, a fuser pad, a rotatable pressure member, a reinforcing member, and a sealing mechanism. The heat roller is configured to heat an outer circumference thereof, and has an elongated longitudinal side opening therein that opens into a hollow interior thereof. The fuser belt is looped for rotation around the heat roller to transfer heat radially outward from the roller circumference. The fuser pad is held substantially stationary along the roller opening outward from the roller interior and inward from the loop of the fuser belt. The pressure member is pressed against the fuser pad through the fuser belt to form a fixing nip through which a recording medium is passed to fix a toner image under heat and pressure. The reinforcing member is disposed within the roller interior to thrust against the fuser pad through the roller opening for reinforcement. The sealing mechanism is disposed on the roller opening to prevent foreign matter from entering the roller interior through the roller opening.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
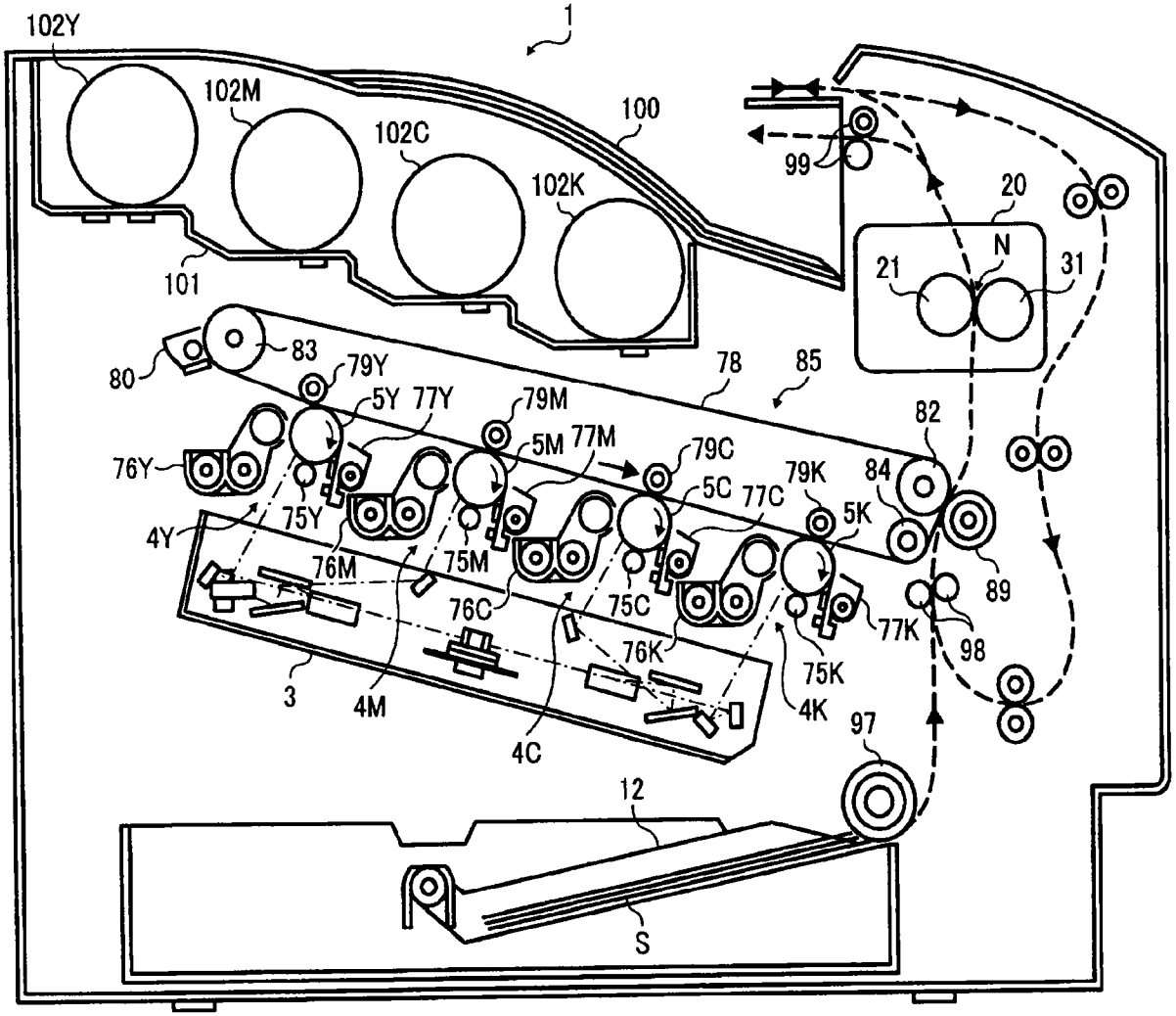
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of ejection rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffix letters, "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or "fixing nip" N therebetween in the sheet conveyance path.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image into visible form using toner. The toner image thus obtained is forwarded to the primary transfer nip between the intermediate transfer belt 85 and the primary transfer roller 79.

At the primary transfer nip, the primary transfer roller 79 applies a bias voltage of a polarity opposite that of toner to the intermediate transfer belt 85. This electrostatically transfers the toner image from the photoconductive surface to an outer surface of the belt 85, with a certain small amount of residual toner particles left on the photoconductive surface. Such transfer process occurs sequentially at the four transfer nips along the belt travel path, so that toner images of different colors are superimposed one atop another to form a multicolor image on the surface of the intermediate transfer belt 85.

After primary transfer, the photoconductive surface enters the cleaning device 77 to remove residual toner by scraping off with a cleaning blade, and then to the discharging device to remove residual charges for completion of one imaging cycle. At the same time, the intermediate transfer belt 85 forwards the multicolor image to the secondary transfer nip between the transfer backup roller 82 and the secondary transfer roller 89.

In the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 85 to the secondary transfer nip. At the secondary transfer nip, the multicolor image is transferred from the belt 85 to the recording sheet S, with a certain small amount of residual toner particles left on the belt surface.

After secondary transfer, the intermediate transfer belt 85 enters the belt cleaner 80, which removes and collects residual toner from the intermediate transfer belt 85. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the output rollers 99 to the output tray 100 for stacking outside the apparatus body, which completes one operational cycle of the image forming apparatus 1.

Figure 2:
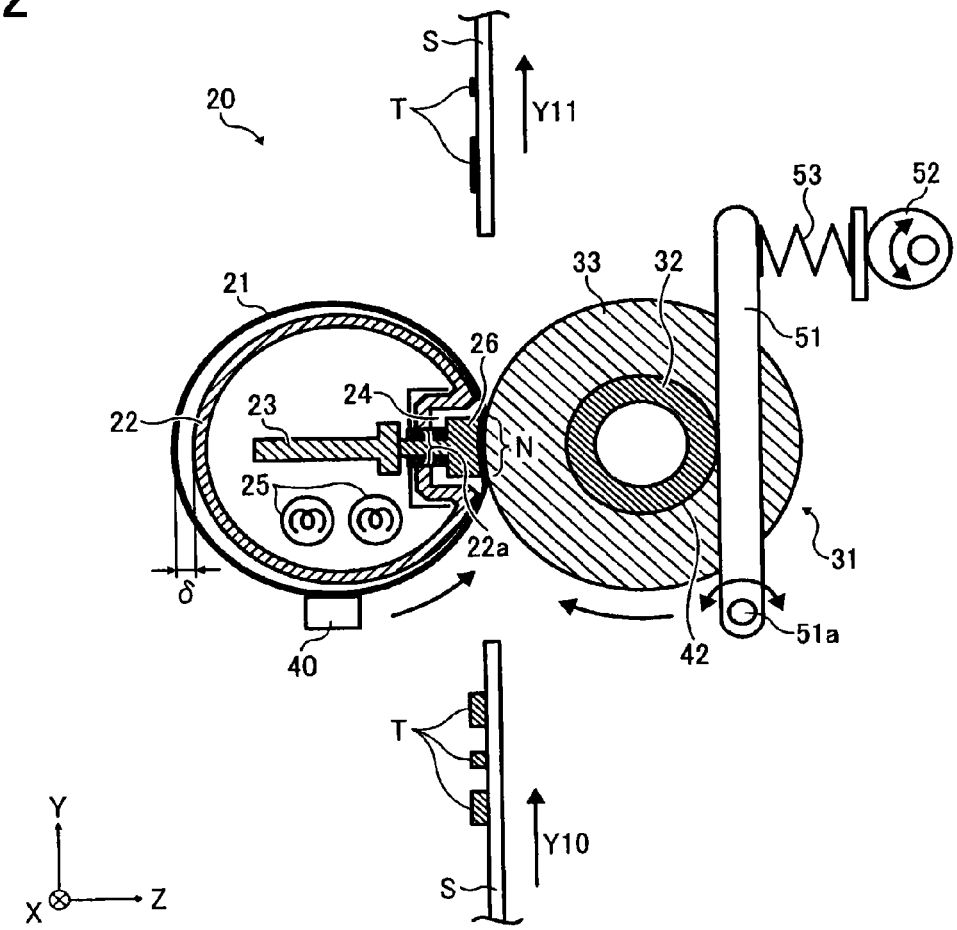
FIG. 2 is an end-on, axial cutaway view schematically illustrating one example of the fixing device incorporated in the image forming apparatus of FIG. 1.
Figure 3:
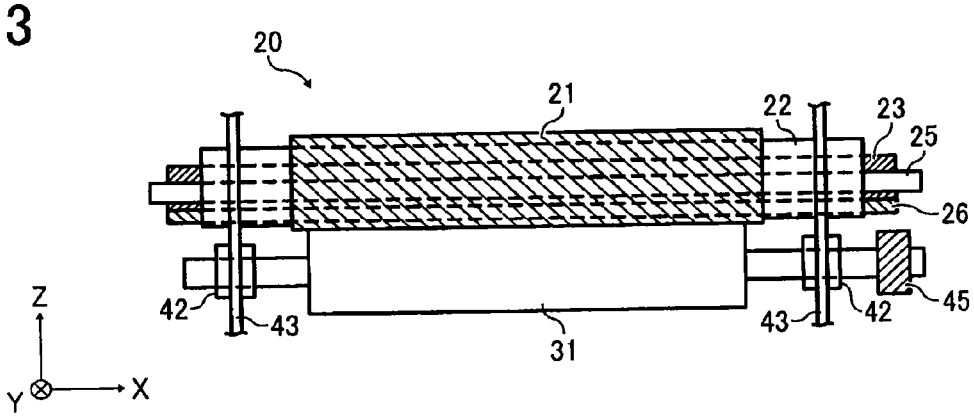
FIG. 3 is a transverse view schematically illustrating the fixing device of FIG. 2.

FIGS. 2 and 3 are end-on, axial cutaway and transverse views, respectively, schematically illustrating the fixing device 20 incorporated in the image forming apparatus 1 according to this patent specification.

As shown in FIGS. 2 and 3, the fixing device 20 includes an endless, flexible fuser belt 21 looped into a generally cylindrical configuration and a pressure roller 31 being a motor-driven rotatable cylinder, which are juxtaposed in parallel between a pair of sidewalls 43, with their longitudinal, rotational axes aligned in an axial direction X, their top and bottom sides oriented in a vertical transaxial direction Y, and their front and rear sides oriented in a horizontal transaxial direction Z perpendicular to the axial direction X.

In the fixing device 20, the looped fuser belt 21 is rotatably held around a hollow, generally cylindrical, stationary open-sided heat roller 22 internally heated with one or more heaters 25 and equipped with a fuser pad 26 combined with a reinforcing member 23. The heat roller 22, the reinforcing member 23, and the fuser pad 26 remain substantially stationary as they hold the rotatable belt 21 in position relative to the pressure roller 31 during operation, while slightly displaceable, for example, for adjusting position in the transaxial direction Z when desired.

The pressure roller 31 is rotatably held on the sidewalls 43 via a pair of bearings 42 displaceable in the transaxial direction Z, and has one end connected to a drive motor, not shown, via a set of one or more gears 45 outside the sidewalls 43. The pressure roller 31 is pressed against the fuser belt 21 by a positioning mechanism consisting of a pressure lever 51, a motor-driven eccentric cam 52, and a spring 53, as shown in FIG. 2, connected to the roller bearing 32 to adjust position of the roller 31 in the transaxial direction Z with respect to the fuser assembly to define a fixing nip N of a desired length along the sheet conveyance path of the image forming apparatus 1.

During operation, the fixing device 20 activates the roller drive motor and the roll heater 25 as the image forming apparatus 1 is powered up. Upon activation, the heater 25 starts heating the fuser belt 21 to a processing temperature by conduction through the heat roller 22, while the pressure roller 31 starts rotation clockwise in FIG. 2 in frictional contact with the fuser belt 21, which in turn rotates around the heat roller 22 counterclockwise in FIG. 2.

Then, a recording sheet S with an unfixed, powder toner image T enters the fixing device 20 with its printed side brought into contact with the fuser belt 21 and the other side with the pressure roller 31. Upon reaching the fixing nip N, the recording sheet S moves along the rotating surfaces of the belt 21 and the roller 31 in the direction of arrow Y10, substantially flat and erect along surfaces of guide plates, not shown, disposed along the sheet conveyance path.

At the fixing nip N, the fuser belt 21 heats the incoming sheet S to fuse and melt the toner particles T, while the pressure roller 31 presses the sheet S against the fuser pad 26 held stationary by the reinforcing member 23 to cause the molten toner T to settle onto the sheet surface. As the toner image T is thus fixed in place through the fixing nip N, the recording sheet S is forwarded to exit the fixing device 20 in the direction of arrow Y11.

In the present embodiment of the fixing device 20, the heat roller 22 comprises a generally cylindrical, open-sided thin-walled hollow member with a substantially C-shaped cross-section, which has two longitudinal edges turned inward toward a hollow interior and spaced apart from each other to form an elongated longitudinal slot or cavity 24 open to the hollow interior through an opening or gap 22*a* defined between the inwardly turned longitudinal edges. It is to be noted that although the present embodiment depicts the heat roller 22 as a cylindrical member, alternatively the generally cylindrical heat roller 22 may be formed in various configurations, including cylinders, prisms, and composite shapes, and the term "substantially C-shaped" refers to any circular or quasi-circular shape resembling the letter "C" defined by straight lines, curves, or a combination of both.

The heat roller 22 is mounted with its longitudinal axis aligned along the axial direction X and its open concave side directed to the pressure roller 31, and is secured in position by fastening a pair of longitudinal ends to the sidewalls 43 of the fixing device 20, while holding the fuser belt 22 around its outer circumference and accommodating the fuser pad 26 within the exterior cavity 24 and the reinforcing member 23 and the heaters 25 within the hollow interior.

Specifically, the heat roller 22 may be formed of a thin wall of thermally conductive material, such as aluminum, iron, stainless steel, or other suitable metal, approximately 0.1 to 0.2 mm in thickness. Forming the heat roller 22 with a wall thickness not exceeding 0.2 mm is desirable for promptly heating the roll circumference to a processing temperature during operation, which leads to reduced warm-up time and high thermal efficiency of the fixing device 20. In the present embodiment, the heat roller 22 is a 0.1 mm-thick walled metal roller, which may be readily obtained by bending a sheet of metal into a rolled configuration through suitable metal working processes.

The heater 25 comprises an elongated, radiation heating element, such as a halogen heater or carbon heater. The heater 25 is inserted into the hollow interior of the heat roller 22, and is secured in position by fastening a pair of longitudinal ends to the sidewalls 43 of the fixing device 20.

The fuser belt 21 comprises a thin, multi-layered, looped flexible belt approximately 1 mm or less in thickness and approximately 15 to 120 mm in diameter (about 30 mm in the present embodiment), the overall length of which is formed of a substrate covered with an intermediate elastic layer and an outer release coating deposited thereon, one atop another. The fuser belt 21 is held around the heat roll 21.

Specifically, the belt substrate may be a layer of metal or resin, such as nickel, stainless steel, polyimide, or the like, approximately 30 to 50 μm in thickness. The intermediate elastic layer may be a deposit of rubber, such as solid or foamed silicone rubber, fluorine resin, or the like, approximately 100 to 300 μm in thickness. The outer coating may be a deposit of a release agent, such as tetra fluoro ethylene-perfluoro alkylvinyl ether copolymer or perfluoroalkoxy (PFA), polytetrafluoroethylene (PTFE), polyimide (PI), polyetherimide (PEI), polyethersulfone (PES), or the like, approximately 10 to 50 μm in thickness.

The intermediate elastic layer serves to accommodate minute variations in applied pressure to maintain smoothness of the belt surface at the fixing nip N, which ensures uniform distribution of heat across a recording sheet S to yield a resulting image with a smooth, consistent appearance. Further, the release coating layer provides good stripping of toner from the belt surface to ensure reliable conveyance of recording sheets S through the fixing nip N.

To warm up the fixing device 20, the radiation heater 25 heats the heat roller 22 directly by radiation from inside, and the fuser belt 21 indirectly by conduction through the heat roller 22. That is, the heater 25 irradiates the inner circumference of the heat roller 22, which then conducts the irradiated heat to those portions of the fuser belt 21 in contact with the roll circumference (i.e., outside the fixing nip N). As the fuser belt 21 rotates, this results in uniformly heating the entire length of the rotating belt 21 sufficiently for fusing toner at the fusing nip N. Such heating is controlled by a controller that regulates power supply according to readings of a thermometer or thermistor 40 sensing temperature of the outer circumference of the fuser belt 21 to maintain a desired processing temperature.

In such a configuration, the fuser belt 21 has its length heated substantially continuously and uniformly by conduction from the outer circumference of the heat roller 22 internally irradiated by the heater 25. Compared to directly and locally heating portions of a fuser member, such indirect continuous heating can warm up the entire length of the fuser belt 21 swiftly and efficiently with a relatively simple configuration, which allows the fixing device 20 to operate at higher processing speeds without causing image defects due to premature entry of recording sheets into the fixing nip N. This leads to a reduction in warm-up time and first-print time required for completing an initial print job upon startup, while maintaining a small size of the image forming apparatus 1 incorporating the fixing device 20.

Preferably, there is a gap δ not exceeding 1 mm between the inner circumference of the fuser belt 21 and the outer circumference of the heat roller 22 except at the fixing nip N where the heat roll circumference forms the side cavity 24. Maintaining the gap 6 between the fuser belt 21 and the heat roller 22 prevents the elastic belt surface from premature wear caused by excessive rubbing against the metal roll surface. Moreover, holding the belt-to-roll gap δ within an adequate range ensures efficient heat transfer from the heat roller 22 to the fuser belt 21, which prevents failures caused by insufficient heating at the fixing nip N, and also maintains the flexible belt 21 in a generally cylindrical configuration around the heat roller 22 for preventing deformation and concomitant deterioration and breakage of the belt 21.

In addition, the fuser belt 21 and the heat roller 22 are provided with a lubricating agent, such as fluorine grease, deposited between their adjoining surfaces. The lubricant reduces friction at the interface to prevent wear and tear on the fuser belt 21 even when operated in continuous frictional contact with the heat roller 22. Similar effects may be obtained by coating the outer surface of the heat roller 22 with a material of a relatively low frictional coefficient, or forming the fuser belt 22 with an innermost layer of lubricant such as a fluorine-based material.

With continued reference to FIGS. 2 and 3, the fuser pad 26 and the reinforcing member 23 are elongated pieces of a length similar to that of the heat roller 22 extending in the axial direction X, the former accommodated inside the side cavity 24 and the latter within the hollow interior of the heat roller 22.

Specifically, the fuser pad 26 is made of composite material, elastic on one side and rigid on the other, and mounted within the side cavity 24 of the heat roller 22, with its longitudinal axis aligned with the axial direction X, its front, elastic side directed toward the pressure roller 31, and its rear, rigid side directed toward the roller opening 22*a*. The fuser pad 26 is secured in position by fastening a pair of longitudinal ends to the sidewalls 43, substantially stationary in the axial direction X and slightly displaceable in the transaxial directions Y and Z, with clearance left between adjoining surfaces of the fuser pad 26 and the roller cavity 24.

The reinforcing member 23 is formed of rigid material, and mounted within the hollow interior of the heat roller 22, with its longitudinal axis aligned with the axial direction X and its front side held against the fuser pad 26 through the side opening 22*a*. The reinforcing member 23 is secured in position by fastening a pair of longitudinal ends to the sidewalls 43.

In such a configuration, the fuser pad 26 has its front side in pressure frictional contact with the inner surface of the fuser belt 21 to establish the fixing nip N where the pressure roller 31 is pressed against the fuser belt 21. Within the roller interior, the reinforcing member 23 thrusts the fuser pad 26 against the pressure roller 31 through the fuser belt 21, so that the fuser pad 26 does not substantially displace or deform in the transaxial direction Z under pressure applied by the pressure roller 31.

Note that, with the fuser pad 26 disposed in the roll cavity 24 to support pressure from the pressure roller 31, the concave-sided heat roller 22 remains substantially unaffected by pressure from the pressure roller 31 at the fixing nip N. That is, provision of the separate fuser pad 26 enables the open-sided heat roller 22 to operate substantially in isolation from the pressure roller 31, which can thus maintain its generally cylindrical configuration without bending or bowing away from the fixing nip N. The reinforcing member 23 serves to strengthen and support the fuser pad 26 in position subjected to pressure from the pressure roller 31 in the fixing nip N.

Such capability to protect the heat roller 22 against deformation under nip pressure is particularly effective in a configuration where the heat roller 22 is extremely thin-walled, with its wall thickness approximately 0.2 mm or less, and therefore is low in strength, for obtaining high thermal efficiency in heating the fuser belt 21. Protection against roller deformation in turn protects the fuser belt 21 against damage and failure, such as slipping off the heat roller or inconsistent heating due to non-uniform contact between the fuser belt and the heat roller, resulting in proper operation of the fixing device 20 according to this patent specification.

Preferably, the reinforcing member 23 is formed of metal, such as stainless steel or iron, which exhibits sufficient stiffness required to support the fuser pad 26 in position and shape. Further, the reinforcing member 23 may have its rear side (i.e., the side that faces the heater 25 upon installation in the hollow interior of the heat roller 22) partially or entirely coated with a thermal insulation coating, or subjected to a bright annealing or mirror polish during manufacture. Such surface treatment enables the reinforcing member 23 to repel or reflect radiation from the heater 25, which allows the heat roller 22 to efficiently absorb heat generated by the heater 25 for transfer to the fuser belt 21, leading to enhanced heating efficiency in the fixing device 20.

With further reference to FIGS. 2 and 3, the pressure roller 31 comprises a cylindrical rotatable body approximately 30 mm in diameter, formed of a hollow, cylindrical metal core 32 covered with an outer layer 33 of elastic material, such as foamed or solid silicone rubber, fluorine rubber, or the like, and optionally, with an additional coating of release agent, such as PFA, PTFE, or the like, deposited on the elastic layer 33. Further, the pressure roller 31 may have a heating element, such as a halogen heater, within the interior of the hollow roller core 32.

Forming the roller outer layer 33 with sponge material is advantageous, since it prevents excessive nip pressure, which would otherwise cause the fuser pad 26 to substantially bend away from the pressure roller 31 at the fixing nip N. Another advantage is that it provides favorable thermal insulation at the fixing nip N to prevent heat transfer from the fuser belt 32 to the pressure roller 31, leading to enhanced heating efficiency in the fixing device 20.

Although the fuser belt 21 and the pressure roller 31 are of a substantially identical diameter in the embodiment depicted in FIGS. 2 and 3, instead, it is possible to provide the cylindrical fixing members 21 and 31 with different diameters, in particular, the fuser belt 21 with a relatively small diameter and the pressure roller 31 with a relatively large diameter. Forming the fuser belt 21 with a diameter smaller than that of the pressure roller 31 translates into a greater curvature of the fuser belt 21 than that of the pressure roller 31 at the fixing nip N, which effects good stripping of a recording sheet from the fuser belt 21 upon exiting the fixing nip N. In any configuration, the concave side of the heat roller 22 is dimensioned so as to isolate the heat roller 22 from the pressure exerted by the pressure roller 31 regardless of the relative diameters of the fuser belt 21 and the pressure roller 31.

As mentioned, the pressure roller 31 is equipped with the positioning mechanism formed of the pressure lever 51, the eccentric cam 52, and the spring 53. The pressure lever 51 has one hinged end provided with a hinge 51*a* and another, free end loaded with the spring 53 connected to the eccentric cam 52 via a spacer, while supporting the rotational axis of the pressure roller 31 via the roller bearing 42 displaceably held on the sidewall 43. The eccentric cam 52 is driven for rotation by a motor, not shown, to cause the pressure lever 51 to swivel on the hinge 51*a*, which in turn displaces the pressure roller 31 either toward or away from the fuser belt 21 in the horizontal transaxial direction Z.

Such positioning mechanism enables the fixing device 20 to move the pressure roller 31 into pressure contact with the fuser belt 21 to form a desired fixing nip by setting the eccentric cam 52 to an operating position (i.e., such as one depicted in FIG. 2) upon entering operation, and to retract the pressure roller 31 away from the fuser belt 21 to remove nip pressure by rotating the eccentric cam 52 by 180 degrees from the operating position when out of operation or under maintenance.

Figure 4:
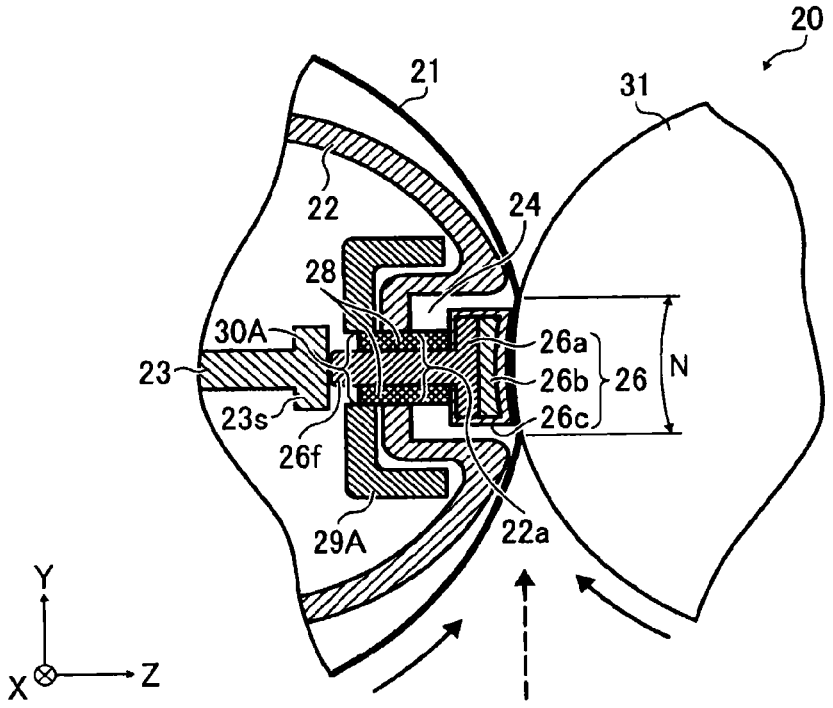
FIG. 4 is an enlarged, end-on, axial cutaway view illustrating a first embodiment of the fixing device according to this patent specification.

Referring now to FIG. 4, which illustrates in detail one embodiment of the fixing device 20 according to this patent specification, there is shown the fixing device 20 including a sealing mechanism 28 disposed on the side opening 22*a* of the heat roller 22 to prevent entry of foreign matter into the roller interior through the opening 22*a*, as well as a shape retaining stay 29A provided on the side cavity 24 of the heat roller 22 interior of the side opening 22*a* to retain the generally cylindrical shape of the heat roller 22. Also shown is the fuser pad 26 with its composite structure mentioned earlier.

Specifically, the shape retaining stay 29A is an open-ended trough-like piece of rigid material with a rectangular U-shaped cross-section configured to closely conform to the bent walls of the heat roller 22 from inside, consisting of a center wall provided with a through-hole 30A and a pair of parallel sidewalls extending from opposing sides of the center wall. For example, the stay 29A may be formed by processing a stainless steel plate approximately 1.5 mm thick into a trough-like configuration. The stay 29A may have its rear side (i.e., the side that faces the heater 25 in the roller interior) at least partially treated through a bright annealing or mirror polish process to increase heating efficiency of the fixing device 20, as in the case of the reinforcing member 23.

The shape retaining stay 29A is fitted on the inner wall of the heat roller 22 over the side cavity 24 with the through-hole 30A aligned with the roller opening 22*a*, so that there is substantially no clearance between the stay wall and the roller wall.

In such a configuration, the shape retaining stay 29A serves to prevent the heat roller 22 from deforming due to elastic recovery of the roll material after bending, known in the art as "springback". That is, the stay 29A clamps together the inwardly turned edges of the roller wall to prevent the gap between the inwardly turned edges from widening, thereby preventing the open-sided roller 22 from losing its generally cylindrical shape and allowing for precisely forming the cavity 24 in a desired configuration.

The fuser pad 26 is formed of a stiff portion 26*a* and an elastic portion 26*b* combined together into a composite structure, which is integrally covered with a lubricant sheet 26*c*. Integral with the stiff portion 26*a* is a rigid flange 26*f*, which extends from the rear side of the fuser pad 26 in the transaxial direction Z for passing through the roller opening 22*a* and the stay through-hole 30A to contact the reinforcing member 23 within the hollow interior of the heat roller 22.

Specifically, the stiff portion 26*a* of the fuser pad 26 is formed of sufficiently stiff material, such as rigid metal or ceramic, to endure pressure from the pressure roller 31. The elastic portion 26*b* is formed of rubber with its exposed side defining a pliant contact surface to establish sliding contact with the pressure roller 31 through the fuser belt 21. The lubricant sheet 26*c* is impregnated with lubricant such as fluorine grease, which reduces frictional resistance between the fuser pad 26 and the fuser belt 21.

The rigid portion 26*a* serves to hold the elastic portion 26*b* in position against the pressure roller 31, and can stand the nip pressure without substantial deformation in the transaxial direction Z. The elastic portion 26*b* closely conforms to minute irregularities in the surface of a toner image processed through the fixing nip N for obtaining good fusing performance, with its contact surface available in various configurations according to particular applications of the fixing device 20.

For example, the contact surface of the elastic portion 26*b* may be slightly concave with a curvature similar to that of the circumference of the pressure roller 31. The concave contact surface readily conforms to the surface of the pressure roller 31 along which a recording sheet S passes through the fixing nip N, which ensures reliable conveyance of the sheet S without adhering to and wrapping around the fuser belt 21 upon exiting the fixing nip N.

Alternatively, instead of the concave configuration, the contact surface of the elastic portion 26*b* may be substantially flat. The flat contact surface causes a recording sheet S to remain straight and uniformly contact the fuser belt 21 within the fixing nip N, resulting in efficient fusing performance, while allowing for good stripping of the recording sheet S from the fuser belt 21 which exhibits a curvature larger at the exit of the fixing nip N than within the fixing nip N.

The fuser pad 26 is installed with clearance left between the surfaces of the fuser pad 26 and the walls and edges of the open side cavity 24 of the heat roller 22. Leaving such clearance prevents the fuser pad 26 from directly contacting the walls of the roller cavity 24. This provides the heat roller 22 with protection against deformation due to interference with the fuser pad 26, which allows for slight displacement of the fuser pad 26 away from the pressure roller 31 upon the reinforcing member 23 yielding under pressure in the transaxial direction Z.

Thus, with the shape retaining stay 29A and the fuser pad 26 provided, the side opening 22*a* of the heat roller 22 remains open where the retaining stay 29A has the through-hole 30A aligned with the opening 22*a* and the flange 26*f* of the fuser pad 26 is spaced away from the edges of the opening 22*a*.

According to this patent specification, the sealing mechanism 28 prevents entry of foreign matter into the hollow interior of the heat roller 22 through the side opening 22*a*, in particular, that of the lubricating agent disposed between the fuser roller 22 and the fuser belt 21 for reducing friction at the interface. As used herein, the term "foreign matter" refers to any substance that is not intended to enter or be present within the roller interior, and includes lubricant and other material forming part of the fuser assembly outside the roller interior.

Leaking lubricant from outside to inside the heat roller not only results in loss of lubrication, which causes high friction at the belt roller interface to aggravate wear and tear of the contacting surfaces, but also results in malfunctioning of or damage to the roller heater where lubricant adheres to the heater and evaporates in the roller interior. Thus, providing the sealing mechanism 28 is particularly effective where the heat roller 22 and the fuser belt 21 are provided with a lubricant with high penetration rates, such as fluorine grease, which is the case for the present embodiment.

Figure 5:
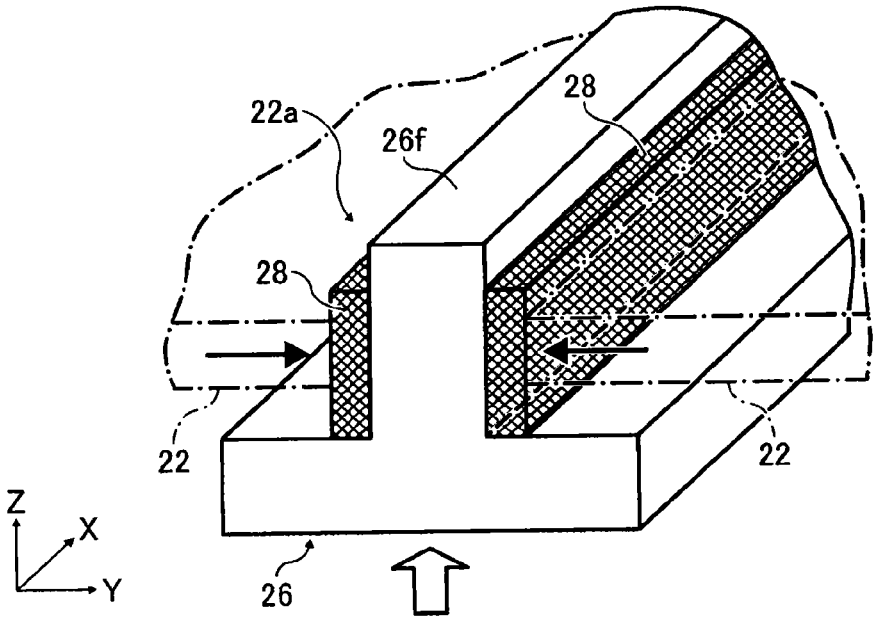
FIG. 5 is a perspective view schematically illustrating a sealing mechanism employed in the first embodiment.

With additional reference to FIG. 5, which is a perspective view schematically illustrating the side opening 22*a* of the heat roller 22 sealed with the sealing mechanism 28 of FIG. 4, in the present embodiment, the sealing mechanism 28 includes a pair of thick, compressible elastic members 28, one along each edge of the roller opening 22*a*. Each sealing member 28 is inserted or packed between the longitudinal edge of the roller opening 22*a* and the flange 26*f* of the fuser pad 26 and fixed in position by attachment to the adjoining surface of the flange 26*f*.

Specifically, the paired sealing member 28 comprises a generally rectangular piece of elastic material, such as silicone rubber, fluorine rubber, or the like. For example, the sealing member 28 may be a generally rectangular piece of silicon rubber or fluorocarbon resin approximately 0.5 mm to approximately 2.0 mm in thickness, which exhibits certain properties desirable as a sealant, such as a high degree of protection against oil leakage, relatively low resistance to compression under a given pressure, and a relatively high degree of heat resistance.

With no load applied, the sealing member 28 has a thickness approximately 8% to 30% greater than the dimension of the gap between the flange 26*f* and the edge of the roller opening 22*a*. Once installed in position, the sealing member 28 is compressed to deform in the direction Y in which the opening edge is pointed, or perpendicular to the direction Z in which the flange 26*f* is inserted into the opening 22*a*, thereby creating a tight seal between the wall of the flange 26*f* and the edge of the roller opening 22*a*.

Note that the direction Y of compression or deformation of the sealing member 28 is perpendicular to the direction Z in which the pressure roller 31 presses against the fuser pad 26. Such discrepancy between the direction Y of compression of the sealing members 28 and the direction Z of pressure on the fuser pad 26 means that the sealing mechanism 28 and the fuser pad 26 are effectively isolated from each other when deformed or displaced during operation. That is, deformation of the sealing member 28 does not affect pressure acting across the fuser pad 26 and the reinforcing member 23 from the pressure roller 31. On the other hand, pressure acting on the fuser pad 26 from the pressure roller 31 is not transmitted to the opening edges of the heat roller 22 through the sealing member 28, which ensures the sealing member 28 reliably closes the roller opening 22*a* even where the fuser pad 26 and the reinforcing member 23 are displaced in the direction Z.

Thus, the sealing mechanism 28 according to this patent specification can properly seal the side opening 22*a* of the thin-walled heat roller 22 without causing the heat roller 22 from interfering with the pressure roller 31 as well as the fuser pad 26 and the reinforcing member 23 establishing nip pressure. Maintaining isolation of the heat roller 22 from the pressure roller 31 ensures immunity of the heat roller 22 against deformation under nip pressure even where the heat roller 22 is of an extremely thin sheet of material, or where the pressure roller 31 presses against the fuser belt 21 at a high nip pressure, or where the pressure roller 31 is displaced toward and away from the fuser belt 21 to adjust the length and pressure of the fixing nip N.

Preferably, the sealing member 28 has a sufficient length in the direction Z perpendicular to the direction Y of its thickness. For example, the sealing member 28 may extend from within the roller opening 22*a* to within the through-hole 30A of the retaining stay 29A. This arrangement provides complete and reliable sealing of the open-sided heat roller 22, wherein the sealing member 28 can close both the roller opening 22*a* and the through-hole 30A aligned to pass the elongated flange 26*f* of the fuser pad 26, while securing closure of the roller opening 22*a* by remaining between the opening edge and the flange 26*f* of the fuser pad 26 even when accidentally displaced in the transaxial direction Z.

More preferably, the sealing member 28 has its end sitting within the through-hole 30A of the retaining stay 29A but not reaching beyond the edge of the through-hole 30A into the roller interior. This arrangement keeps the sealing member 28 away from exposure to direct heating by the roller heater 25 inside the roller interior, thereby preventing the sealing member 28 from deterioration due to heat.

More preferably still, a radiant heat shield is disposed between the radiation heater 25 and the sealing member 28 to protect the sealing mechanism from irradiation by the heater 25. For example, such shielding may be accomplished by forming the reinforcing member 23 with a relatively large shield surface 23*s* on its front side (i.e., the side facing the fuser pad 26) to cover the through-hole 30A of the retaining stay 29A. The shielding 23*s* prevents light and heat from reaching inside the through-hole 30A, thereby protecting the sealing mechanism 28 from direct exposure to irradiation and resultant thermal deterioration.

Additionally, the sealing mechanism 28 may be used with the heat roller 22 configured as a thin-walled pipe with a wall thickness not exceeding approximately 0.2 millimeters for obtaining high thermal efficiency. The capability of the sealing member 28 to provide proper sealing while maintaining isolation between the heat roller 22 and the pressure mechanism allows for use of such an extremely thin-walled heat roller without causing deformation of the heat roller and concomitant failures of the fuser belt in the fixing device.

Hence, the fixing device 20 according to this patent specification can operate with extremely short warm-up time and first-print time required to process an initial print job at start-up, while exhibiting high immunity to failures caused by insufficient heating of the fuser belt in high speed application, owing to the thermally conductive heat roller 22 swiftly and uniformly heating the fuser belt 26.

Stable and proper functioning of the fixing device 20 is ensured by the sealing mechanism 28 according to this patent specification, which provides reliable sealing of the open-sided heat roller 22 against entry of lubricant and other foreign matter without causing deformation of the heat roller 22 even where the heat roller 22 is of an extremely thin sheet of material, or where the pressure roller 31 presses against the fuser belt 21 at a high nip pressure, or where the pressure roller 31 is displaced toward and away from the fuser belt 21 to adjust the length and pressure of the fixing nip N.

Although the embodiment depicted above uses the pair of thick compressible sealing members 28 each configured as a generally rectangular piece of elastic material attached to the elongated flange 26*f* of the fuser pad 26, the configuration and disposition of the sealing members 28 may be other than that depicted with reference to FIGS. 4 and 5.

For example, the sealing members 28 may be fixed in position by attachment to the respective edges of the through-hole 30A of the retaining stay 29A, or to the respective edges of the opening 22*a* of the heat roller 22, instead of by attachment to the flange 26*f* of the fuser pad 26. Further, the sealing members 28 may be disposed around the flange 26*f* of the fuser pad 26 through integral molding instead of attachment after molding as separate parts.

Moreover, in further embodiments, the fixing device 20 according to this patent specification have the sealing mechanism arranged for use with various types of fuser assemblies using an open-sided heat roller, as described below with reference to FIG. 6 and subsequent drawings.

Figure 6:
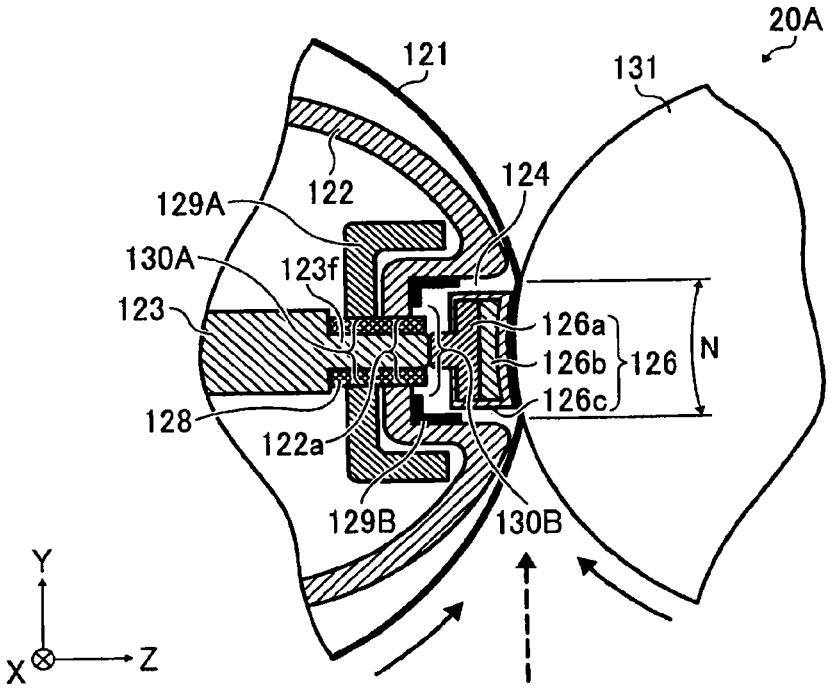
FIG. 6 is an enlarged, end-on, axial cutaway view illustrating a second embodiment of the fixing device according to this patent specification.

FIG. 6 is an enlarged, end-on, axial cutaway view illustrating a second embodiment 20A of the fixing device according to this patent specification.

As shown in FIG. 6, the fixing device 20A is similar to that depicted primarily with reference to FIG. 4, consisting of a fuser belt 121 looped around a generally cylindrical, open concave-sided hollow stationary heat roller 122 with its side opening 122*a* sealed with a sealing mechanism 128 and its side cavity 124 accommodating a fuser pad 126 held against a heat roller 131 through the thickness of belt 121 to form a fixing nip N, as well as a reinforcing member 123 supporting the fuser pad 126 in position from within the roller interior, and a shape retaining stay 129A, slotted with a single elongated through-hole 130A, disposed on the roller opening 122*a* to retain the generally cylindrical shape of the heat roller 122 from within the roller interior.

Although not depicted in the drawing, the fixing device 20A is also equipped with a roller heater and a thermometer for controlling temperature of the fixing nip N, as well as a pressure roller positioning mechanism formed of a pressure lever, an eccentric cam, and a spring, for adjusting length and pressure of the fixing nip N, similar to those used in the embodiment of FIG. 4.

Unlike the embodiment of FIG. 4, the second embodiment of the fixing device 20A has the reinforcing member 123 provided with an elongated flange 123*a* on the front side to contact the fuser pad 126, which in turn is provided with a relatively short flange on the rear side to contact the reinforcing flange 123*a*. Also unlike the first embodiment, the second embodiment uses the shape retaining stay 129A in combination with an additional, second shape retaining stay 129B disposed exterior of the roller opening 122*a* to retain the generally cylindrical shape of the heat roller 122 by clamping together the inwardly turned edges of the roller 122.

Specifically, the second shape retaining stay 129B is a box-like piece of rigid material with a rectangular U-shaped cross-section configured to closely follow the bent walls of the heat roller 122 from outside, consisting of a center wall provided with a through-hole 130B and a pair of generally parallel sidewalls extending from opposing sides of the center panel and connecting to each other at both ends thereof. For example, the second stay 129B may be formed by processing a stainless steel plate approximately 0.5 mm thick into a box-like configuration.

The second stay 129B is press-fitted on the outer wall of the heat roller 122 within the side cavity 124 with the through-hole 130B aligned with the roller opening 122*a*. Using the second retaining stay 129B in addition to the first retaining stay 129A ensures secure retention of the generally cylindrical shape of the heat roller 122 as well as reliable protection against deformation or springback of the heat roller 122.

The reinforcing member 123 has its elongated flange 123*f* inserted through the through-hole 130A of the first retaining stay 129A, the opening 122*a* of the heat roller 122, and the through-hole 130B of the second retaining stay 129B to reach the roller cavity 124, with clearance left around the flange 123*a* within the through-hole 130A to prevent interference between the heat roller 122 and the reinforcing member 123.

In the second embodiment, the sealing mechanism 128 includes a pair of thick, compressible elastic members similar to those depicted with reference to FIGS. 4 and 5, each inserted or packed between the longitudinal edge of the roller opening 122*a* and the flange 123*f* of the reinforcing member 123 and fixed in position by attachment to the adjoining surface of the flange 123*f*.

Specifically, the sealing member 128 comprises a generally rectangular piece of elastic material, such as silicone rubber, fluorine rubber, or the like. With no load applied, the sealing member 28 has a thickness greater than the dimension of the gap between the flange 123*f* and the edge of the roller opening 122*a*. Once installed in position, the sealing member 128 is compressed between the flange surface and the opening edge, thereby creating a tight seal between the wall of the flange 123*f* and the edge of the roller opening 122*a*. As in the case with the first embodiment, the sealing member 128 is sufficiently long to close both the roller opening 122*a* and the through-hole 130A.

In such a configuration, the sealing mechanism 128 according to this patent specification can properly seal the side opening 122*a* of the thin-walled heat roller 122 without causing the heat roller 122 from interfering with the pressure roller 131 as well as the fuser pad 126 and the reinforcing member 123 in the manner depicted above for the first embodiment, so as to prevent the heat roller 122 from deformation under nip pressure in the fixing device 20A.

Hence, the fixing device 20A according to this patent specification can operate with extremely short warm-up time and first-print time required to process an initial print job at startup, while exhibiting high immunity to failures caused by insufficient heating of the fuser belt in high speed application, owing to the thermally conductive heat roller 122 swiftly and uniformly heating the fuser belt 126.

Stable and proper functioning of the fixing device 20A is ensured by the sealing mechanism 128 according to this patent specification, which provides reliable sealing of the open-sided heat roller 122 against entry of lubricant and other foreign matter without causing deformation of the heat roller 122 even where the heat roller 122 is of an extremely thin sheet of material, or where the pressure roller 131 presses against the fuser belt 121 at a high nip pressure, or where the pressure roller 131 is displaced toward and away from the fuser belt 121 to adjust the length and pressure of the fixing nip N.

Figure 7:
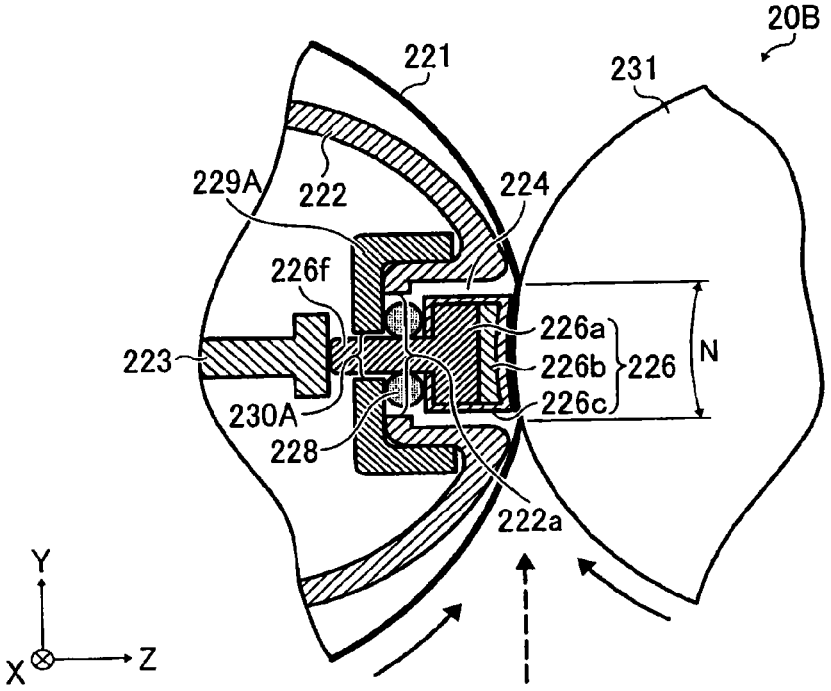
FIG. 7 is an enlarged, end-on, axial cutaway view illustrating a third embodiment of the fixing device according to this patent specification.

FIG. 7 is an enlarged, end-on, axial cutaway view illustrating a third embodiment 20B of the fixing device according to this patent specification.

As shown in FIG. 7, the fixing device 20B is similar to that depicted primarily with reference to FIG. 4, consisting of a fuser belt 221 looped around a generally cylindrical, open concave-sided hollow stationary heat roller 222 with its side opening 222*a* sealed with a sealing mechanism 228 and its side cavity 224 accommodating a fuser pad 226 held against a heat roller 231 through the thickness of belt 221 to form a fixing nip N, as well as a reinforcing member 223 supporting the fuser pad 226 in position from within the roller interior, and a shape retaining stay 229A disposed on the roller opening 222*a* to retain the generally cylindrical shape of the heat roller 222 from within the roller interior.

Although not depicted in the drawing, the fixing device 20B is also equipped with a roller heater and a thermometer for controlling temperature of the fixing nip N. Unlike the embodiment of FIG. 4, the fixing device 20B has no mechanism for adjusting position of the pressure roller 231, such as one formed of a pressure lever, an eccentric cam, and a spring.

Figure 8:
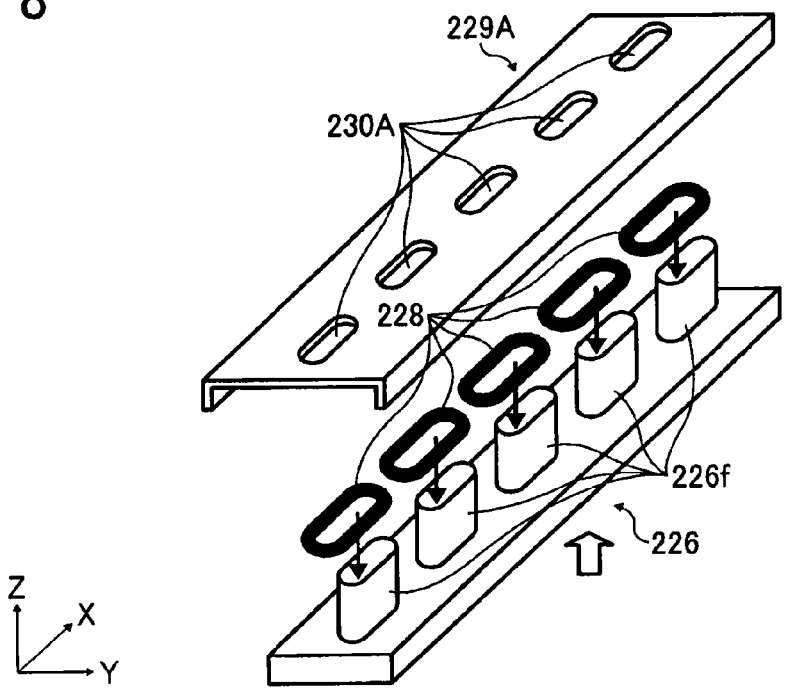
FIG. 8 is an exploded view schematically illustrating a sealing mechanism employed in the third embodiment.

With additional reference to FIG. 8, which is an exploded view of the fuser pad 226 and the shape retaining stay 229A being assembled, the shape retaining stay 229A has its center wall perforated with a series of multiple, relatively small through-holes 230A, narrower than the opening 222*a* of the heat roller 222 along the transaxial direction Y, arranged in the axial direction X for alignment with the roller opening 222*a*, and the fuser pad 226 is provided with a series of multiple flanges 226*f* arranged on its rear side in the axial direction X to contact the reinforcing member 223 through the roller opening 222*a* and the through-holes 230A.

During assembly, the multi-perforated stay 229A and the multi-flanged fuser pad 226 are mounted on the open side of the heat roller 222, the former inside and the latter outside the roller interior, with each of the series of flanges 226*f* inserted into the roller opening 222*a* and a corresponding one of the through-holes 230A aligned with each other, with clearance left around the flange 226*f* within the opening 222*a* as well as within the through-hole 230A.

In the third embodiment, the sealing mechanism 228 includes a set of multiple annular sealing members held around the flange 226*f* of the fuser pad 226 away from the longitudinal edge of the roller opening 224 while sandwiched between the opposed walls the multi-flanged fuser pad 226 and the multi-perforated retaining stay 229A.

Specifically, each of the multiple sealing members 228 comprises an O-ring formed of elastic material, such as silicone rubber, fluorine rubber, or the like. With no load applied, each sealing member 228 has a thickness greater than the dimension of the gap between the opposed walls of the flange 226*f* and the retaining stay 229A. The sealing member 228 is fitted on a corresponding one of the multiple flanges 226*f* of the fuser pad 226, and pressed between the opposed walls of the stay 229A and the fuser pad 226 as the flange 226*f* is inserted into the roller opening 222*a* and the through-hole 230A. Once installed in position, the sealing member 228 is compressed to lose approximately 3% to approximately 30% of its original thickness, thereby creating a tight seal within the opening 222*a* of the heat roller 222.

Note that, contrary to the cases with the paired sealing members 28, compression or deformation of the annular sealing member 228 occurs in the direction Z in which the pressure roller 231 presses against the fuser pad 226. This arrangement is allowable in the fixing device 20B which does not have an adjustment mechanism to adjust position of the pressure roller 231 relative to the fuser pad 226 so that the amount of compression remains substantially constant within a specified range, which ensures a consistent tight fitting of the sealing member 228 to the adjacent walls.

Further, the sealing mechanism 228 spaced away from the edge of the roller opening 222*a* does not affect immunity against deformation of the heat roller 222 provided with the fuser pad 226 and the shape retaining stay 229A. That is, the lack of contact between the sealing member 228 and the adjacent edges of the roller opening 222*a* means the sealing member 228 does not substantially transmit force from the fuser pad 226 to the opening edge, so that no pressure acts on the opening edge to deform the heat roller 222 when the pressure roller 231 presses against the fuser pad 226.

In addition, should the retaining stay 229A deform under pressure transmitted from the pressure roller 231 through the sealing member 228, such deformation occurs in the direction Z different from the direction Y in which the opening edges are clamped together by the shape retainer 229A to retain the roller shape, and hence does not cause substantial deformation and concomitant defects of the heat roller 222.

Furthermore, disposing the sealing member 228 between the opposed walls of the first retaining stay 229A and the fuser pad 226 within the roller opening 222*a* facilitates design and installation of the fixing device 20B owing to a relatively large space for placing the sealing member 228, compared to a configuration where the sealing member is disposed outside the roller opening, for example, in a space defined between the opposed walls of the fuser pad and the second shape retainer within the side cavity.

Preferably, the multiple sealing members 228 used in the fixing device 20B have different thicknesses and/or stiffnesses adjusted depending on the relative positions of their associated flanges 226*f* along the length of the fuser pad 226 extending in the axial direction X, so as to compensate for axial variation in contact pressure between the reinforcing member 223 and the fuser pad 226.

Specifically, the sealing member 228 mounted on the flange 226*f* at the center of the fuser pad 226 is thicker and/or stiffer than that mounted on the flange 226*f* at each end of the fuser pad 226, where the reinforcing member 223 and the fuser pad 226, with their respective ends fixed in position but their centers displaceable from each other, establish a varying contact pressure that is lower at the center and higher at each end along the axial direction X. This arrangement allows the multiple sealing members 228 to contact the wall of retaining stay 229A at a substantially uniform contact pressure, resulting in a uniform, reliable sealing of the roller opening 222*a* against entry of foreign matter along the length of the heat roller 222.

Although the heat roller 222 described above is an open-sided roller with a single elongated opening obtained by bending a sheet of thermally conductive material, alternatively, instead, it is also possible that the fixing device 20B use an at least partially close-sided heat roller obtained by bending a sheet of thermally conductive material with two longitudinal edges spaced away from each other and partially welded together to form a series of multiple openings arranged along the roller length. In such cases, the number and positions of the roller openings are matched with those of the multiple through-holes 230A of the stay 229A.

Hence, the fixing device 20B according to this patent specification can operate with extremely short warm-up time and first-print time required to process an initial print job at start-up, while exhibiting high immunity to failures caused by insufficient heating of the fuser belt in high speed application, owing to the thermally conductive heat roller 222 swiftly and uniformly heating the fuser belt 226.

Stable and proper functioning of the fixing device 20B is ensured by the sealing mechanism 228 according to this patent specification, which provides reliable sealing of the open-sided heat roller 222 against entry of lubricant and other foreign matter without causing deformation of the heat roller 222 even where the heat roller 222 is of an extremely thin sheet of material, or where the pressure roller 231 presses against the fuser belt 221 at a high nip pressure.

Figure 9:
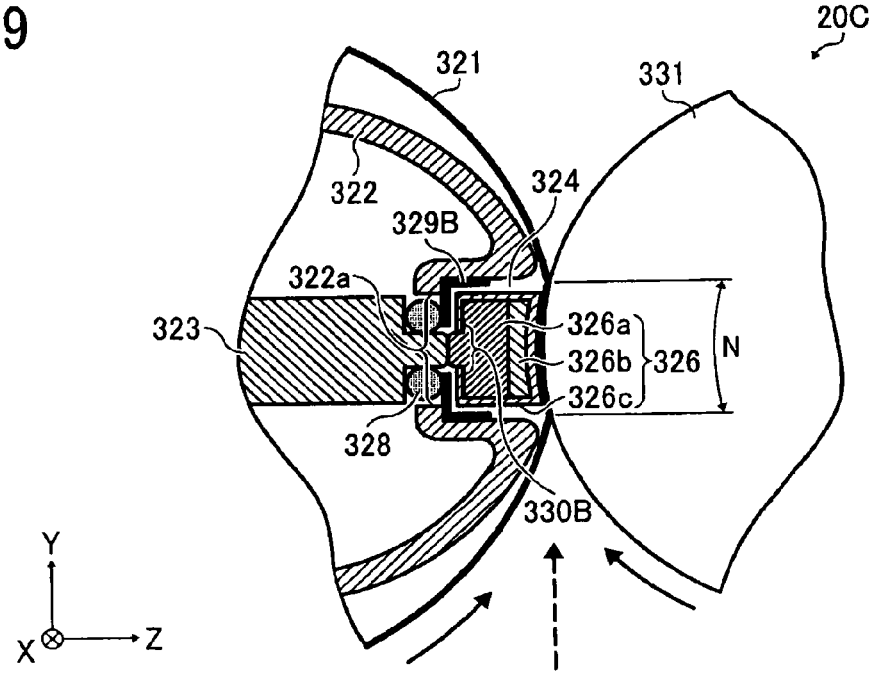
FIG. 9 is an enlarged, end-on, axial cutaway view illustrating a fourth embodiment of the fixing device according to this patent specification.

FIG. 9 is an enlarged, end-on, axial cutaway view illustrating a fourth embodiment 20C of the fixing device according to this patent specification.

As shown in FIG. 9, the fixing device 20C is similar to that depicted with reference to FIG. 6, consisting of a fuser belt 321 looped around a generally cylindrical, open concave-sided hollow stationary heat roller 322 with its side opening 322*a* sealed with a sealing mechanism 328 and its side cavity 324 accommodating a fuser pad 326 held against a heat roller 331 through the thickness of belt 321 to form a fixing nip N, as well as a reinforcing member 323 supporting the fuser pad 326 in position from within the roller interior.

Although not depicted in the drawing, the fixing device 20C is also equipped with a roller heater and a thermometer for controlling temperature of the fixing nip N. Unlike the embodiment of FIG. 6, the present embodiment of the fixing device 20C has no mechanism for adjusting position of the pressure roller 331, such as one formed of a pressure lever, an eccentric cam, and a spring. Also unlike the embodiment of FIG. 6, this embodiment uses a single shape retaining stay 329B, instead of the combination of the first and second stays 129A and 129B, disposed on the roller opening 322*a* to retain the generally cylindrical shape of the heat roller 322 from outside the roller interior.

Specifically, the shape retaining stay 329B has its center wall perforated with a series of multiple, relatively small through-holes 330, narrower than the opening 322*a* of the heat roller 322 along the transaxial direction Y, arranged in the axial direction X for alignment with the roller opening 322*a*, and the reinforcing member 323 is provided with a series of multiple flanges 323*f* arranged on its front side in the axial direction X to contact the fuser pad 326 through the roller opening 322*a* and the through-holes 330B.

During assembly, the multi-perforated stay 329B and the multi-flanged reinforcing member 323 are mounted on the open side of the heat roller 322, the former outside and the latter inside the roller interior, with each of the series of flanges 323*f* inserted into the roller opening 322*a* and a corresponding one of the through-holes 330B aligned with each other, with clearance left around the flange 323*f* within the opening 322*a* as well as within the through-hole 330B.

In the fourth embodiment, the sealing mechanism 328 includes a set of multiple annular sealing members held around the flange 323*f* of the reinforcing member 323 away from the longitudinal edge of the roller opening 324 while sandwiched between the opposed walls the multi-flanged reinforcing member 323 and the multi-perforated retaining stay 329B.

Specifically, each of the multiple sealing members 328 comprises an O-ring formed of elastic material, such as silicone rubber, fluorine rubber, or the like. With no load applied, each sealing member 328 has a thickness greater than the dimension of the gap between the opposed walls of the flange 323*f* and the retaining stay 329B. The sealing member 328 is fitted on a corresponding one of the multiple flanges 323*f* of the reinforcing member 323, and pressed between the opposed walls of the stay 329B and the reinforcing member 323 as the flange 323*f* is inserted into the roller opening 322*a* and the through-hole 330B. Once installed in position, the sealing member 328 is compressed to create a tight seal within the opening 322*a* of the heat roller 322.

In such a configuration, the sealing mechanism 328 provides a tight, reliable seal on the opening 322*a* of the heat roller 322, because of the facts discussed above with respect to the embodiment of FIGS. 7 and 8. Further, disposing the sealing member 328 between the opposed walls of the first retaining stay 329B and the fuser pad 326 within the roller opening 322*a* facilitates design and installation of the fixing device 20C owing to a relatively large space for placing the sealing member 328, compared to a configuration where the sealing member is disposed outside the roller opening, for example, in a space defined between the opposed walls of the reinforcing member and the first shape retainer within the roller interior.

Hence, the fixing device 20C according to this patent specification can operate with extremely short warm-up time and first-print time required to process an initial print job at startup, while exhibiting high immunity to failures caused by insufficient heating of the fuser belt in high speed application, owing to the thermally conductive heat roller 322 swiftly and uniformly heating the fuser belt 326.

Stable and proper functioning of the fixing device 20C is ensured by the sealing mechanism 328 according to this patent specification, which provides reliable sealing of the open-sided heat roller 322 against entry of lubricant and other foreign matter without causing deformation of the heat roller 322 even where the heat roller 322 is of an extremely thin sheet of material, or where the pressure roller 231 presses against the fuser belt 321 at a high nip pressure.

Figure 10:
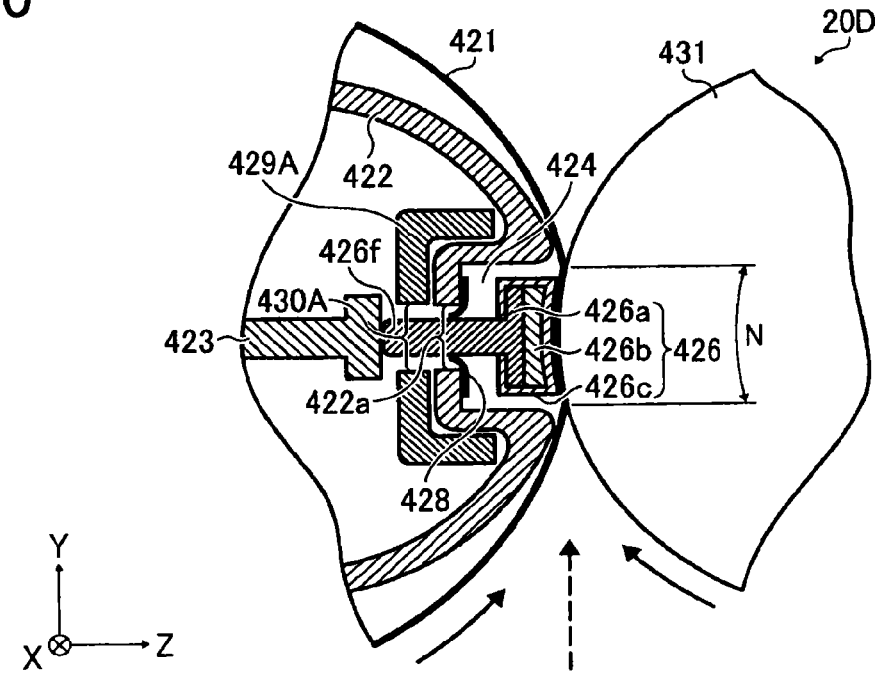
FIG. 10 is an enlarged, end-on, axial cutaway view illustrating a fifth embodiment of the fixing device according to this patent specification.

FIG. 10 is an enlarged, end-on, axial cutaway view illustrating a fifth embodiment 20D of the fixing device according to this patent specification.

As shown in FIG. 10, the fixing device 20D is similar to that depicted primarily with reference to FIG. 4, consisting of a fuser belt 421 looped around a generally cylindrical, open concave-sided hollow stationary heat roller 422 with its side opening 422*a* sealed with a sealing mechanism 428 and its side cavity 424 accommodating a fuser pad 426 held against a heat roller 431 through the thickness of belt 421 to form a fixing nip N, as well as a reinforcing member 423 supporting the fuser pad 426 in position from within the roller interior, and a shape retaining stay 429A disposed on the roller opening 422*a* to retain the generally cylindrical shape of the heat roller 422 from within the roller interior.

Although not depicted in the drawing, the fixing device 20D is also equipped with a roller heater and a thermometer for controlling temperature of the fixing nip N, as well as a pressure roller positioning mechanism formed of a pressure lever, an eccentric cam, and a spring, for adjusting length and pressure of the fixing nip N, similar to those used in the embodiment of FIG. 4.

In the fifth embodiment, the sealing mechanism 428 comprises a pair of thin, flexible sealing members disposed between the longitudinal edge of the roller opening 422*a* and the flange 426*f* of the fuser pad 426.

Specifically, the sealing member 428 comprises a thin, elongated plate of flexible material of the substantially same length of the roller opening 422*a*. The sealing member 428 has one end fixed to one longitudinal edge of the roller opening 422*a* and another end, free and opposite the fixed end, directed away from the opening edge. As the fuser pad 426 is installed within the roller side cavity 424 with its flange 426*f* inserted into the roller opening 422*a* from outside to inside the roller interior, the free end of the sealing member 428 bends to establish a close contact with the flange 426*f* of the fuser pad 426, thereby creating a tight seal between the longitudinal edge of the roller opening 422*a* and the flange 426*f* of the fuser pad 426.

Hence, the fixing device 20D according to this patent specification can operate with extremely short warm-up time and first-print time required to process an initial print job at startup, while exhibiting high immunity to failures caused by insufficient heating of the fuser belt in high speed application, owing to the thermally conductive heat roller 422 swiftly and uniformly heating the fuser belt 426.

Stable and proper functioning of the fixing device 20D is ensured by the sealing mechanism 428 according to this patent specification, which provides reliable sealing of the open-sided heat roller 422 against entry of lubricant and other foreign matter without causing deformation of the heat roller 422 even where the heat roller 422 is of an extremely thin sheet of material, or where the pressure roller 431 presses against the fuser belt 421 at a high nip pressure, or where the pressure roller 431 is displaced toward and away from the fuser belt 421 to adjust the length and pressure of the fixing nip N.

Figure 11:
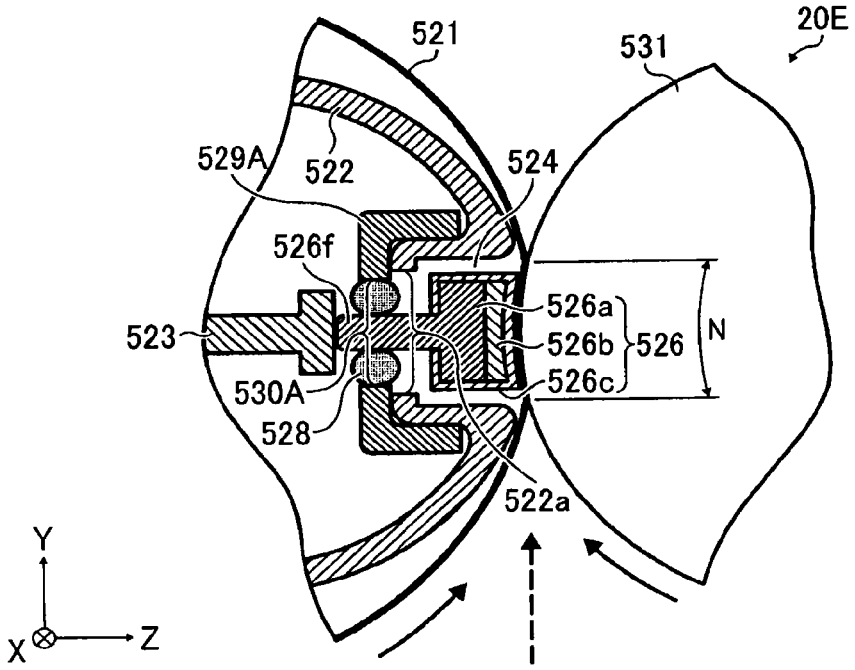
FIG. 11 is an enlarged, end-on, axial cutaway view illustrating a sixth embodiment of the fixing device according to this patent specification.

FIG. 11 is an enlarged, end-on, axial cutaway view illustrating a sixth embodiment 20E of the fixing device according to this patent specification.

As shown in FIG. 11, the fixing device 20E is similar to that depicted primarily with reference to FIG. 4, consisting of a fuser belt 521 looped around a generally cylindrical, open concave-sided hollow stationary heat roller 522 with its side opening 522*a* sealed with a sealing mechanism 528 and its side cavity 524 accommodating a fuser pad 526 held against a heat roller 531 through the thickness of belt 521 to form a fixing nip N, as well as a reinforcing member 523 supporting the fuser pad 526 in position from within the roller interior, and a shape retaining stay 529A disposed on the roller opening 522*a* to retain the generally cylindrical shape of the heat roller 522 from within the roller interior.

Although not depicted in the drawing, the fixing device 20E is also equipped with a roller heater and a thermometer for controlling temperature of the fixing nip N. Unlike the embodiment of FIG. 4, the present embodiment of the fixing device 20E has no mechanism for adjusting position of the pressure roller 531, such as one formed of a pressure lever, an eccentric cam, and a spring.

Figure 12:
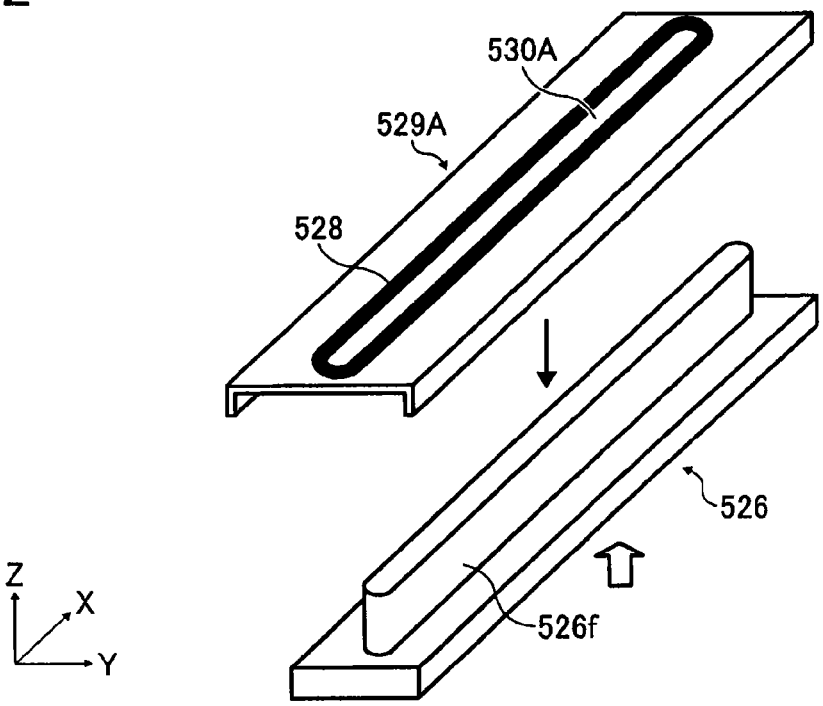
FIG. 12 is an exploded view schematically illustrating a sealing mechanism employed in the sixth embodiment.

With additional reference to FIG. 12, which is an exploded view of the fuser pad 526 and the shape retaining stay 529A being assembled, the retaining stay 529A is slotted with a single elongated through-hole 530A narrower than the opening 522*a* of the heat roller 522 along the transaxial direction Y, and the fuser pad 526 is provided with a flange 526*f* smaller in cross-section than the through-hole 530A in the transaxial directions Y and Z, as in the case with the embodiment of FIG. 4.

In the sixth embodiment, the sealing mechanism 528 comprises a single annular sealing member 528 held around the flange 526*f* of the fuser pad 526 away from the longitudinal edge of the roller opening 522*a* while sandwiched between the opposed surfaces of the fuser pad flange 526 and the retaining stay through-hole 530A.

Specifically, the sealing member 528 comprises an O-ring formed of elastic material, such as silicone rubber, fluorine rubber, or the like. With no load applied, the sealing member 528 has a thickness greater than the dimension of the gap between the opposed surfaces of the flange 526 and the through-hole 530A. The sealing member 528 is fixed on an inner edge of the through-hole of the retaining stay the flange 526*f* of the fuser pad 526, and pressed between the opposed surfaces of the flange 526 and the through-hole 530A as the flange 526*f* is inserted into the roller opening 522*a* and the through-hole 530A. Once installed in position, the sealing member 228 is compressed to create a tight seal on the opening 522*a* of the heat roller 522.

Figure 13:
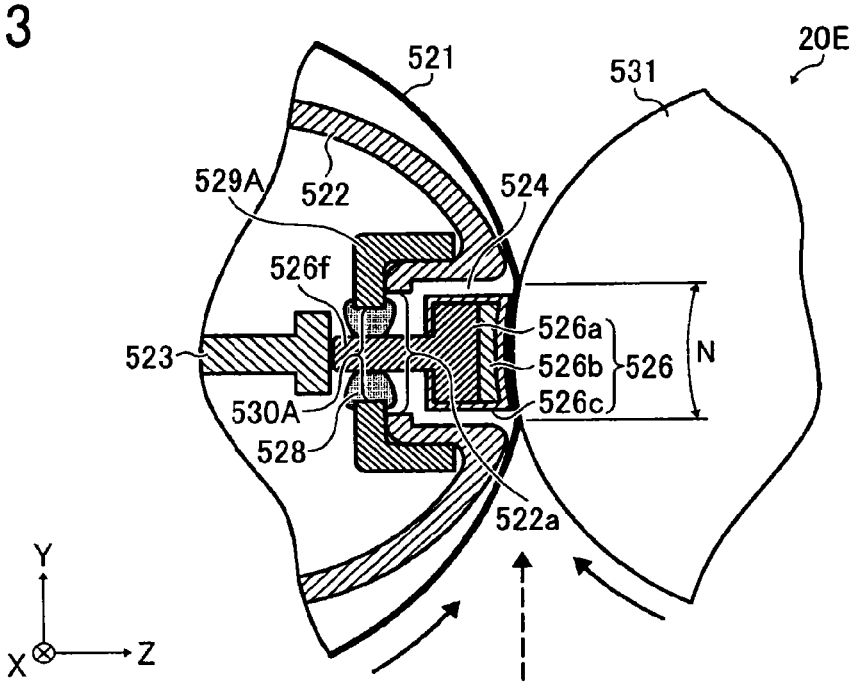
FIG. 13 is an enlarged, end-on, axial cutaway view illustrating an arrangement of the sixth embodiment.
Figure 14:
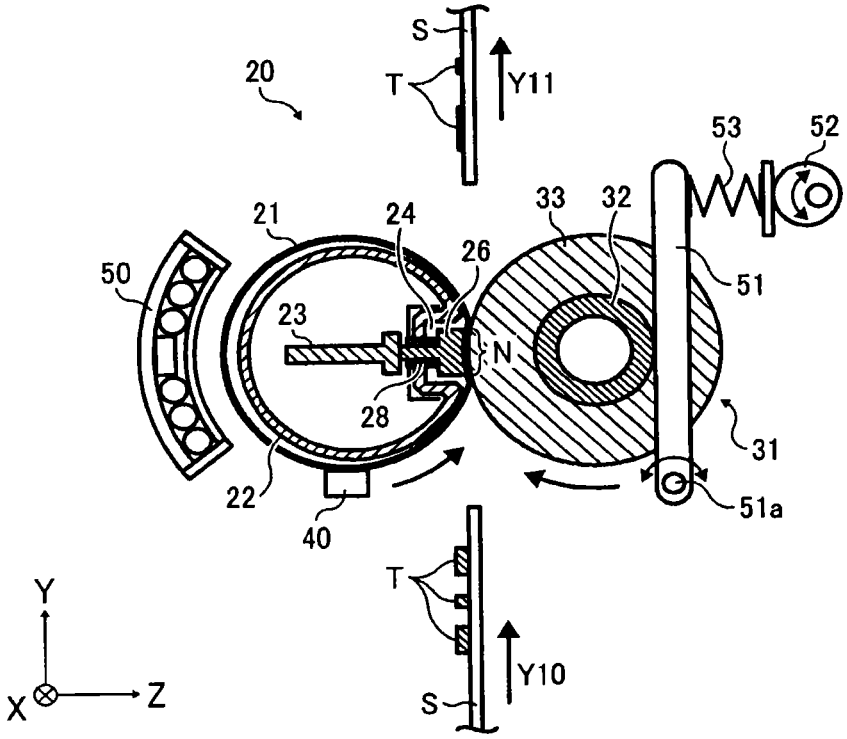
FIG. 14 is an end-on, axial cutaway view schematically illustrating another example of the fixing device incorporated in the image forming apparatus of FIG. 1.

In the embodiment depicted in FIGS. 11 and 12, the sealing member 528 is integrally formed with the retaining stay 529A through integral molding during manufacture. Alternatively, instead, the sealing member 528 may be fitted on the retaining stay 529A after molding, as shown in FIG. 13.

Hence, the fixing device 20E according to this patent specification can operate with extremely short warm-up time and first-print time required to process an initial print job at start-up, while exhibiting high immunity to failures caused by insufficient heating of the fuser belt in high speed application, owing to the thermally conductive heat roller 522 swiftly and uniformly heating the fuser belt 526.

Stable and proper functioning of the fixing device 20E is ensured by the sealing mechanism 528 according to this patent specification, which provides reliable sealing of the open-sided heat roller 522 against entry of lubricant and other foreign matter without causing deformation of the heat roller 522 even where the heat roller 522 is of an extremely thin sheet of material, or where the pressure roller 531 presses against the fuser belt 521 at a high nip pressure.

Although several embodiments depicted above describe different configurations of the sealing mechanism used with particular types of fuser assembly, each sealing member disclosed herein can be applied, with appropriate modification, to any type of fuser assembly to provide effective sealing on the open-sided heat roller.

Further, although the embodiments depicted above describe the sealing mechanism with a specific number of flanges provided on the fuser pad and the reinforcing member, and a specific number of openings or through-holes provided on the heat roller and the shape retaining stays, all the embodiments of the sealing mechanism according to this patent specification may be configured with any number of flanges and any number of openings or through-holes.

Furthermore, although the embodiments depicted above uses a radiation heater to heat the heat roller in the fixing device, heating the heat roller may be accomplished by any suitable heating mechanism, such as an induction heater with an electromagnetic coil mounted on or adjacent to the circumference of the heat roller, as described below with reference to FIG. 12.

As shown in FIG. 12, the fixing device 20 may use an induction heater 50 that heats the roller circumference from outside the roller interior by electromagnetic induction, in place of the radiation heater 25 disposed within the roller interior to heat the roller circumference through radiation.

Specifically, the induction heater 50 consists of a set of electromagnetic coils or Litz wires each being a bundle of thinner wires extending across a portion of the fuser belt 21 in the axial direction X and opposed to a semi-cylindrical main core formed of a ferromagnetic material with a high magnetic permeability ranging from approximately 1000 to approximately 3000, and optionally equipped with auxiliary central and/or side cores for efficient formation of magnetic flux, all of which are held by a coil support of suitable material such as heat resistant resin or the like.

During operation, the induction heater 50 generates an alternating magnetic field around the heat roller 22 as a high-frequency alternating current passes through the electromagnetic coils. The changing magnetic field induces eddy currents over the circumference of the heat roller 22, which exhibits certain electrical resistivity to produce a corresponding amount of Joule heat from within.

The heat roller 21 thus heated through electromagnetic induction releases heat to the length of the fuser belt 21 rotating in close contact with the roller circumference, resulting in heating the fixing nip N to a desired processing temperature.

For maximizing heating efficiency through electromagnetic induction, preferably, the induction heater 50 extends over the entire circumference of the heat roller 22. In addition, the heat roller 22 is made of any suitable metal, including, but not limited to, nickel, stainless steel, iron, copper, cobalt, chromium, aluminum, gold, platinum, silver, tin, palladium, and alloys containing one or more of these metals.

Still further, the fixing device 20 according to this patent specification may use a resistance heater such as a ceramic heater, instead of radiation heating or induction heating. Such resistance heating may be accomplished with a substrate of electrically resistive heating element with its opposed ends connected to a power supply, disposed within the hollow interior of the heat roller 22 with its surface attached to part or entire area of the inner circumference of the heat roller 22.

During operation, the resistance heater is supplied with a current from the power supply to generate an amount of heat proportional to the electrical resistance of the heating element for conduction to the inner circumference of the heat roller 21. The heat roller 21 thus heated through resistance heating releases heat to the length of the fuser belt 21 rotating in close contact with the roller circumference, resulting in heating the fixing nip N to a desired processing temperature.

Alternatively, instead of providing a resistance heater separate from the heat roller, it is also possible to generate heat by employing the heat roller 22 as an electrical resistor, in which case the heat roller 22 is configured into a thin-walled roller of electrically resistive heating material with two ends connected to a power supply from which a supply of current flows across the heating element to generate heat for releasing to the length of the fuser belt 21.

Thus, the fixing device 20 according to this patent specification may be configured with various types of fuser assemblies and various types of roller heaters, and the heat roller sealing mechanism according to this patent specification provides reliable sealing of the open-sided heat roller against entry of lubricant and other foreign matter without causing deformation of the heat roller, thereby ensuring stable and proper functioning of the fixing device 20.

Numerous additional modifications and variations are possible in light of the above teachings. For example, although the embodiments described above employ a pressure roller with its rotational axis held on a positioning mechanism, the fixing device according to this patent specification may be configured with any suitable rotatable body equipped with a biasing member, such as an endless belt looped for rotation around a certain supporting member, to press against the fuser pad to form a fixing nip.

Further, although the embodiments described above employ a multi-layered fuser belt formed of a substrate combined with elastic and releasing layers, the fixing device according to this patent specification may be configured with an endless belt or film of any suitable material, such as any one or combination of polyimide, polyamide, fluorine resin, and metal, looped for rotation around the heat roll while heated.

It is therefore to be understood that, within the scope of the appended claims, the disclosure of this patent specification may be practiced otherwise than as specifically described herein.

What is claimed is:

1. A fixing device comprising:

a fuser belt with a loop, that is flexible and subjected to heating;

a fuser pad held substantially stationary inward from the loop of the fuser belt;

a rotatable pressure member disposed opposite the fuser belt for pressing against the fuser pad through the fuser belt to form a fixing nip through which a recording medium is passed to fix a toner image under heat and pressure; and a reinforcing member disposed inside the loop of the fuser belt to thrust against the fuser pad for reinforcement, wherein the fuser pad includes one or more protrusions each extending to contact the reinforcing member inside the loop of the fuser belt, and wherein the fuser pad comprises a contact surface which is flat.

2. The fixing device according to claims 1, wherein the fuser pad has only a single protrusion to contact the reinforcing member inside the loop of the fuser belt.

3. The fixing device according to claim 1, wherein the fuser pad has multiple protrusions to contact the reinforcing member inside the loop of the fuser belt.

4. The fixing device according to claim 3, wherein the multiple protrusions are arranged in series in a direction in which the fuser pad extends.

5. The fixing device according to claim 1, wherein the1 protrusion of the fuser pad is shaped in a generally cylindrical shape.

6. The fixing device according to claim 1, further comprising: a hollow stationary heat roller to heat an outer circumference thereof, wherein the flexible fuser belt is looped around the heat roller to transfer heat radially outward from the outer circumference of the roller.

7. The fixing device according to claim 6, wherein the heat roller has an elongated longitudinal side opening therein that opens into a hollow interior thereof, wherein the reinforcing member is disposed within the hollow interior of the heat roller to thrust against the fuser pad through the roller opening, and wherein the fixing device further includes a sealing mechanism disposed on the roller opening to prevent foreign matter from entering the roller interior through the roller opening.

8. An image forming apparatus incorporating the fixing device according to claim 1.

9. The fixing device according to claim 1, wherein: the one or more protrusions each comprise an elongate flange.

10. The fixing device according to claim 1, wherein:

the fuser belt includes a substrate, an elastic layer, and a release coating, the substrate includes nickel and has a thickness from 30 μm to 50 μm, the elastic layer includes a rubber material and has a thickness from 100 μm to 300 μm, and the release layer has a thickness from 10 μm to 50 μm.

11. The fixing device according to claim 1, wherein:

the fuser belt includes a substrate, an elastic layer, and a release coating, the substrate includes stainless steel and has a thickness from 30 μm to 50 μm, the elastic layer includes a rubber material and has a thickness from 100 μm to 300 μm, and the release layer has a thickness from 10 μm to 50 μm.

12. A fixing device comprising:

a fuser belt with a loop, that is flexible and subjected to heating;

a fuser pad held substantially stationary inward from the loop of the fuser belt;

a rotatable pressure member disposed opposite the fuser belt for pressing against the fuser pad through the fuser belt to form a fixing nip through which a recording medium is passed to fix a toner image under heat and pressure; and a reinforcing member disposed inside the loop of the fuser belt to thrust against the fuser pad for reinforcement, wherein the fuser pad includes one or more protrusions each extending to contact the reinforcing member inside the loop of the fuser belt, and wherein the fuser pad comprises a contact surface which is concave.

13. The fixing device according to claims 12, wherein the fuser pad has only a single protrusion to contact the reinforcing member inside the loop of the fuser belt.

14. The fixing device according to claim 12, wherein the fuser pad has multiple protrusions to contact the reinforcing member inside the loop of the fuser belt.

15. The fixing device according to claim 14, wherein the multiple protrusions are arranged in series in a direction in which the fuser pad extends.

16. The fixing device according to claim 12, wherein the protrusion of the fuser pad is shaped in a generally cylindrical shape.

17. The fixing device according to claim 12, further comprising: a hollow stationary heat roller to heat an outer circumference thereof, wherein the flexible fuser belt is looped around the heat roller to transfer heat radially outward from the outer circumference of the roller.

18. The fixing device according to claim 17, wherein the heat roller has an elongated longitudinal side opening therein that opens into a hollow interior thereof, wherein the reinforcing member is disposed within the hollow interior of the heat roller to thrust against the fuser pad through the roller opening, and wherein the fixing device further includes a sealing mechanism disposed on the roller opening to prevent foreign matter from entering the roller interior through the roller opening.

19. The fixing device according to claim 12, wherein:

the fuser belt includes a substrate, an elastic layer, and a release coating, the substrate includes nickel and has a thickness from 30 μm to 50 μm, the elastic layer includes a rubber material and has a thickness from 100 μm to 300 μm, and the release layer has a thickness from 10 μm to 50 μm.

20. The fixing device according to claim 12, wherein:

the fuser belt includes a substrate, an elastic layer, and a release coating, the substrate includes stainless steel and has a thickness from 30 μm to 50 μm, the elastic layer includes a rubber material and has a thickness from 100 μm to 300 μm, and the release layer has a thickness from 10 μm to 50 μm.

21. A fixing device comprising:

a flexible fuser belt including a loop, the fuser belt to be heated;

a fuser pad disposed substantially stationary inside the loop of the fuser belt;

a rotatable pressure member disposed opposite the fuser belt for pressing against the fuser pad through the fuser belt to form a fixing nip through which a recording medium is passed to fix a toner image using heat and pressure; and a reinforcing member disposed inside the loop of the fuser belt to thrust against the fuser pad for reinforcement in a pressing direction which is a direction which the fuser pad is pressed towards the rotatable pressure member by the reinforcing member, wherein the fuser pad includes one or more protrusions each extending along the pressing direction to contact the reinforcing member inside the loop of the fuser belt.

22. The fixing device according to claims 21, wherein the fuser pad has only a single protrusion to contact the reinforcing member inside the loop of the fuser belt.

23. The fixing device according to claim 21, wherein the fuser pad has multiple protrusions to contact the reinforcing member inside the loop of the fuser belt.

24. The fixing device according to claim 23, wherein the multiple protrusions are arranged in series in a direction in which the fuser pad extends.

25. The fixing device according to claim 21, wherein the protrusion of the fuser pad is shaped in a generally cylindrical shape.

26. The fixing device according to claim 21, further comprising:

a hollow stationary heat roller to heat an outer circumference thereof, wherein the flexible fuser belt is looped around the heat roller to transfer heat radially outward from the outer circumference of the roller.

27. The fixing device according to claim 26, wherein:

the heat roller has an elongated longitudinal side opening therein that opens into a hollow interior thereof, the reinforcing member is disposed within the hollow interior of the heat roller to thrust against the fuser pad through the roller opening, and the fixing device further includes a sealing mechanism disposed on the roller opening to prevent foreign matter from entering the roller interior through the roller opening.

28. An image forming apparatus incorporating the fixing device according to claim 21.

29. The fixing device according to claim 21, wherein:

the one or more protrusions each comprise an elongate flange.

30. The fixing device according to claim 21, wherein:

the fuser belt includes a substrate, an elastic layer, and a release coating, the substrate includes nickel and has a thickness from 30 μm to 50 μm, the elastic layer includes a rubber material and has a thickness from 100 μm to 300 μm, and the release layer has a thickness from 10 μm to 50 μm.

31. The fixing device according to claim 21, wherein:

the fuser belt includes a substrate, an elastic layer, and a release coating, the substrate includes stainless steel and has a thickness from 30 μm to 50 μm, the elastic layer includes a rubber material and has a thickness from 100 μm to 300 μm, and the release layer has a thickness from 10 μm to 50 μm.

32. A fixing device comprising:

a flexible fuser belt including a loop, the fuser belt to be heated;

a fuser pad disposed substantially stationary inside the loop of the fuser belt;

a rotatable pressure member disposed opposite the fuser belt for pressing against the fuser pad through the fuser belt to form a fixing nip through which a recording medium is passed to fix a toner image using heat and pressure;

a mechanism to reduce the pressure between the rotatable pressure member and the fuser belt; and a reinforcing member disposed inside the loop of the fuser belt to thrust against the fuser pad for reinforcement, wherein the fuser pad includes one or more protrusions to contact the reinforcing member inside the loop of the fuser belt.

33. The fixing device according to claims 32, wherein the fuser pad has only a single protrusion to contact the reinforcing member inside the loop of the fuser belt.

34. The fixing device according to claim 32, wherein the fuser pad has multiple protrusions to contact the reinforcing member inside the loop of the fuser belt.

35. The fixing device according to claim 34, wherein the multiple protrusions are arranged in series in a direction in which the fuser pad extends.

36. The fixing device according to claim 32, wherein the protrusion of the fuser pad is shaped in a generally cylindrical shape.

37. The fixing device according to claim 32, further comprising:

a hollow stationary heat roller to heat an outer circumference thereof, wherein the flexible fuser belt is looped around the heat roller to transfer heat radially outward from the outer circumference of the roller.

38. The fixing device according to claim 37, wherein:

the heat roller has an elongated longitudinal side opening therein that opens into a hollow interior thereof, the reinforcing member is disposed within the hollow interior of the heat roller to thrust against the fuser pad through the roller opening, and the fixing device further includes a sealing mechanism disposed on the roller opening to prevent foreign matter from entering the roller interior through the roller opening.

39. An image forming apparatus incorporating the fixing device according to claim 32.

40. The fixing device according to claim 32, wherein:

the one or more protrusions each comprise an elongate flange.

41. The fixing device according to claim 32, wherein the mechanism to reduce the pressure comprises:

an eccentric cam.

42. The fixing device according to claim 41, wherein the mechanism to reduce the pressure further comprises:

a pressure lever; and a spring, wherein rotation of the eccentric cam causes an increase of pressure of the spring against the pressure lever which urges the rotatable pressure member against the fuser belt.

43. The fixing device according to claim 32, wherein:

the fuser belt includes a substrate, an elastic layer, and a release coating, the substrate includes nickel and has a thickness from 30 μm to 50 μm, the elastic layer includes a rubber material and has a thickness from 100 μm to 300 μm, and the release layer has a thickness from 10 μm to 50 μm.

44. The fixing device according to claim 32, wherein:

the fuser belt includes a substrate, an elastic layer, and a release coating, the substrate includes stainless steel and has a thickness from 30 μm to 50 μm, the elastic layer includes a rubber material and has a thickness from 100 μm to 300 μm, and the release layer has a thickness from 10 μm to 50 μm.

* * * * *